US009754601B2

(12) United States Patent
Hirschfeld et al.

(10) Patent No.: US 9,754,601 B2
(45) Date of Patent: Sep. 5, 2017

(54) INFORMATION SIGNAL ENCODING USING A FORWARD-ADAPTIVE PREDICTION AND A BACKWARDS-ADAPTIVE QUANTIZATION

(75) Inventors: Jens Hirschfeld, Hering (DE); Gerald Schuller, Erfurt (DE); Manfred Lutzky, Nuremberg (DE); Ulrich Kraemer, Ilmenau (DE); Stefan Wabnik, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1507 days.

(21) Appl. No.: 12/300,602

(22) PCT Filed: Feb. 28, 2007

(86) PCT No.: PCT/EP2007/001730

§ 371 (c)(1),
(2), (4) Date: May 15, 2009

(87) PCT Pub. No.: WO2007/131564

PCT Pub. Date: Nov. 22, 2007

(65) Prior Publication Data

US 2009/0254783 A1 Oct. 8, 2009

(30) Foreign Application Priority Data

May 12, 2006 (DE) ..... 10 2006 022 346

(51) Int. Cl.
*G10L 19/06* (2013.01)
*G10L 19/032* (2013.01)
(Continued)

(52) U.S. Cl.
CPC ..... *G10L 19/06* (2013.01); *G10L 19/0017* (2013.01); *G10L 19/035* (2013.01); *G10L 19/032* (2013.01)

(58) Field of Classification Search
CPC ..... G10L 19/008; G10L 19/24; G10L 19/167; G10L 21/038; G10L 19/00; G10L 25/27;
(Continued)

(56) References Cited

U.S. PATENT DOCUMENTS 4,385,393 A * 5/1983 Chaure et al. ..... 375/249
4,677,671 A 6/1987 Galand et al.
(Continued)

FOREIGN PATENT DOCUMENTS

DE WO 2005/078704 A1 * 8/2005 ..... G10L 19/00
DE 102004007184 A1 9/2005
(Continued)

OTHER PUBLICATIONS

Tzeng. "Analysis-by-Synthesis Linear Predictive Speech Coding at 2.4 kbit/s" 1989.*
(Continued)

*Primary Examiner* — James Wozniak
(74) *Attorney, Agent, or Firm* — Perkins Coie LLP; Michael A. Glenn

(57) ABSTRACT

A very coarse quantization exceeding the measure determined by the masking threshold without or only very little quality losses is enabled by quantizing not immediately the prefiltered signal, but a prediction error obtained by forward-adaptive prediction of the prefiltered signal. Due to the forward adaptivity, the quantizing error has no negative effect on the prediction on the decoder side.

17 Claims, 9 Drawing Sheets

(51) Int. Cl.
*G10L 19/00* (2013.01)
*G10L 19/035* (2013.01)

(58) Field of Classification Search
CPC ..... G10L 25/69; G10L 19/02; G10L 19/10; G10L 19/0204; G10L 19/035; G10L 19/0017; G10L 19/032; G10L 19/06; G11B 20/10527; H04B 1/665; G06F 3/16; H04M 3/2236; H05K 999/99
USPC ..... 704/500, 200.1, E19.001, E19.002, 704/E19.01
See application file for complete search history.

(56) References Cited

U.S. PATENT DOCUMENTS

| | | | | |
|---|---|---|---|---|
| 4,751,736 | A * | 6/1988 | Gupta et al. | 704/230 |
| 5,138,662 | A * | 8/1992 | Amano | G10L 19/12 704/219 |
| 5,142,583 | A * | 8/1992 | Galand | G10L 19/08 704/219 |
| 5,347,478 | A * | 9/1994 | Suzuki | G10H 7/02 704/211 |
| 5,699,484 | A * | 12/1997 | Davis | 704/200.1 |
| 5,781,888 | A * | 7/1998 | Herre | 704/200.1 |
| 5,926,785 | A * | 7/1999 | Akamine | G10L 19/083 704/219 |
| 5,956,674 | A * | 9/1999 | Smyth et al. | 704/200.1 |
| 6,101,464 | A * | 8/2000 | Serizawa | G10L 19/06 704/219 |
| 6,104,996 | A * | 8/2000 | Yin | 704/500 |
| 6,377,915 | B1 * | 4/2002 | Sasaki | G10L 19/04 704/206 |
| 6,401,062 | B1 * | 6/2002 | Murashima | G10L 19/10 704/219 |
| 6,487,535 | B1 * | 11/2002 | Smyth et al. | 704/500 |
| 6,675,148 | B2 * | 1/2004 | Hardwick | 704/500 |
| 6,778,953 | B1 * | 8/2004 | Edler et al. | 704/200.1 |
| 6,810,381 | B1 * | 10/2004 | Sasaki | G10L 19/18 704/200.1 |
| 6,950,794 | B1 * | 9/2005 | Subramaniam et al. | 704/200.1 |
| 7,110,953 | B1 * | 9/2006 | Edler et al. | 704/200.1 |
| 7,171,355 | B1 * | 1/2007 | Chen | 704/226 |
| 2001/0053973 | A1 | 12/2001 | Tsuzuki | |
| 2002/0147584 | A1 * | 10/2002 | Hardwick | 704/229 |
| 2002/0184005 | A1 * | 12/2002 | Gigi | 704/201 |
| 2003/0149559 | A1 * | 8/2003 | Lopez-Estrada | 704/200.1 |
| 2004/0015346 | A1 * | 1/2004 | Yasunaga | H03M 7/3082 704/219 |
| 2004/0093208 | A1 * | 5/2004 | Yin | 704/230 |
| 2004/0181398 | A1 * | 9/2004 | Sung | G10L 19/24 704/219 |
| 2004/0184537 | A1 * | 9/2004 | Geiger et al. | 375/240.11 |
| 2005/0114126 | A1 * | 5/2005 | Geiger et al. | 704/230 |
| 2006/0147124 | A1 * | 7/2006 | Edler et al. | 382/260 |
| 2006/0271355 | A1 * | 11/2006 | Wang | G10L 19/005 704/220 |
| 2006/0271357 | A1 * | 11/2006 | Wang et al. | 704/223 |
| 2007/0016402 | A1 * | 1/2007 | Schuller et al. | 704/200.1 |
| 2007/0016403 | A1 * | 1/2007 | Schuller et al. | 704/200.1 |
| 2007/0027678 | A1 * | 2/2007 | Hotho et al. | 704/203 |
| 2007/0043557 | A1 | 2/2007 | Schuller et al. | |
| 2007/0100639 | A1 * | 5/2007 | Den Brinker et al. | 704/500 |
| 2007/0112560 | A1 * | 5/2007 | Gerrits et al. | 704/205 |
| 2007/0124139 | A1 * | 5/2007 | Chen | 704/219 |
| 2008/0027720 | A1 * | 1/2008 | Kondo | G10L 19/26 704/219 |
| 2008/0112632 | A1 * | 5/2008 | Vos et al. | 382/248 |
| 2009/0240492 | A1 * | 9/2009 | Zopf et al. | 704/219 |

FOREIGN PATENT DOCUMENTS

| | | | | |
|---|---|---|---|---|
| GB | 2150377 | | 6/1985 | |
| GB | 2159377 | | 11/1985 | |
| RU | 2144222 | C1 | 10/2000 | |
| WO | WO 00/63886 | | 10/2000 | |
| WO | WO 02/082425 | | 10/2002 | |
| WO | WO 2005/078703 | | 8/2005 | |
| WO | WO 2005078705 | A1 * | 8/2005 | G10L 19/00 |

OTHER PUBLICATIONS

Edler et al. "Audio Coding Using a Psychoacoustic Pre- and Post-Filter" 2000.*
Liebchen et al. "Improved Forward-Adaptive Prediction for MPEG-4 Audio Lossless Coding" May 31, 2005.*
Vass et al. "Adaptive Forward-Backward Quantizer for Low Bit Rate High Quality Speech Coding" 1997.*
Kramer et al. "Ultra Low Delay audio coding with constant bit rate" 2004.*
Lutzky et al. "Structural analysis of low latency audio coding schemes" 2005.*
Wabnik et al. "Packet Loss Concealment in Predictive Audio Coding" 2005.*
Harma. "Evaluation of a Warped Linear Predictive Coding Scheme" 2000.*
Wylie. "apt-X100: Low-Delay,Low-Bit-RateSubband ADPCM Digital Audio Coding" 1995.*
de Bont et al. "A High Quality Audio-Coding System at 128kb/s" 1995.*
Edler, et al. "Audio coding using a psychoacoustic pre-and post-filter." Acoustics, Speech, and Signal Processing, 2000. ICASSP'00. Proceedings. 2000 IEEE International Conference on. vol. 2. IEEE, Jun. 2000, pp. 881-884.*
Schuller, Gerald, and Aki Hanna. "Low delay audio compression using predictive coding." Acoustics, Speech, and Signal Processing (ICASSP), 2002 IEEE International Conference on. vol. 2. IEEE, May 2002, pp. 1853-1856.*
Edler, Bernd, et al. "Perceptual audio coding using a time-varying linear pre-and post-filter." Audio Engineering Society Convention 109. Audio Engineering Society, Sep. 2000, pp. 1-12.*
Russian Decision to Grant, with English Translation, in related Russian Patent Application No. 2008148961, Decision dated Jun. 9, 2010, 26 pages.
Schuller, et al.; "Low delay audio compression using predictive coding"; May 13-17, 2002; IEEE International Conference on Acoustics, Speech, and Signal Processing, vol. 4, p. II-1853, XP010804256, ISBN: 0-7803-7402-9.
Wabnik, et al.; "Reduced Bit Rate Ultra Low Delay Audio Coding"; May 20, 2006; 120th AES Convention, XP002437647.
Wabnik, et al.; "Different Quantisation Noise Shaping Methods for Predictive Audio Coding"; May 14-19, 2006; IEEE Acoustics, Speech and Signal Processing, vol. 5.
Wabnik, et al; "Frequency Warping in Low Delay Audio Coding"; Mar. 18-23, 2005; ICASSP, vol. 3, pp. III-181 through III-184.
Lutzky, et al; "A guideline to audio codec delay"; May 8-11, 2004; Presented at the 116th Convention Audio Engineeering Society, Convention Paper 6062, pp. 1-10.
Schuller, et al.; "Perceptual Audio Coding Using Adaptive Pre- and Post-Filters and Lossless Compression";Sep. 2002; IEEE Transactions on Speech and Audio Processing, vol. 10, No. 6, pp. 379-390.
Edler, et al.; "Perceptual Audio Coding Using a Time-Varying Linear Pre- and Post-Filter"; Sep. 22-25, 2000; AES 109th Convention.

* cited by examiner

INFORMATION SIGNAL ENCODING USING A FORWARD-ADAPTIVE PREDICTION AND A BACKWARDS-ADAPTIVE QUANTIZATION

CROSS-REFERENCE TO RELATED APPLICATIONS

This application is a 371 National Entry of PCT/EP2007/001730 filed 28 Feb. 2007, which claims priority to German Patent Application No. 102006022346.2 filed 12 May 2006.

BACKGROUND OF THE INVENTION

The present invention relates to information signal encoding, such as audio or video encoding.

The usage of digital audio encoding in new communication networks as well as in professional audio productions for bi-directional real time communication necessitates a very inexpensive algorithmic encoding as well as a very short encoding delay. A typical scenario where the application of digital audio encoding becomes critical in the sense of the delay time exists when direct, i.e. unencoded, and transmitted, i.e. encoded and decoded signals are used simultaneously. Examples therefore are live productions using cordless microphones and simultaneous (in-ear) monitoring or "scattered" productions where artists play simultaneously in different studios. The tolerable overall delay time period in these applications is less than 10 ms. If, for example, asymmetrical participant lines are used for communication, the bit rate is an additional limiting factor.

The algorithmic delay of standard audio encoders, such as MPEG-1 3 (MP3), MPEG-2 AAC and MPEG-2/4 low delay ranges from 20 ms to several 100 ms, wherein reference is made, for example, to the article M. Lutzky, G. Schuller, M. Gayer; U. Kraemer, S. Wabnik: "A guideline to audio codec delay", presented at the 116$^{th}$ AES Convention, Berlin, May 2004. Voice encoders operate at lower bit rates and with less algorithmic delay, but provide merely a limited audio quality.

The above outlined gap between the standard audio encoders on the one hand and the voice encoders on the other hand is, for example, closed by a type of encoding scheme described in the article B. Edler, C. Faller and G. Schuller, "Perceptual Audio Coding Using a Time-Varying Linear Pre- and Postfilter", presented at 109$^{th}$ AES Convention, Los Angeles, September 2000, according to which the signal to be encoded is filtered with the inverse of the masking threshold on the encoder side and is subsequently quantized to perform irrelevance reduction, and the quantized signal is supplied to entropy encoding for performing redundancy reduction separate from the irrelevance reduction, while the quantized prefiltered signal is reconstructed on the decoder side and filtered in a postfilter with the marking threshold as transmission function. Such an encoding scheme, referred to as ULD (Ultra Low Delay) encoding scheme below, results in a perceptual quality that can be compared to standard audio encoders, such as MP3, for bit rates of approximately 80 kBit/s per channel and higher. An encoder of this type is, for example, also described in WO 2005/078703 Al.

Particularly, the ULD encoders described there use psychoacoustically controlled linear filters for forming the quantizing noise. Due to their structure, the quantizing noise is on the given threshold, even when no signal is in a given frequency domain. The noise remains inaudible, as long as it corresponds to the psychoacoustic masking threshold. For obtaining a bit rate that is even smaller than the bit rate as predetermined by this threshold, the quantizing noise has to be increased, which makes the noise audible. Particularly, the noise becomes audible in domains without signal portions. Examples therefore are very low and very high audio frequencies. Normally, there are only very low signal portions in these domains, while the masking threshold is high. If the masking threshold is increased uniformly across the whole frequency domain, the quantizing noise is at the increased threshold, even when there is no signal, so that the quantizing noise becomes audible as a signal that sounds spurious. Subband-based encoders do not have this problem, since the same simply quantize subbands having smaller signals than the threshold to zero.

The above-mentioned problem that occurs when the allowed bit rate falls below the minimum bit rate, which causes no spurious quantizing noise and which is determined by the masking threshold, is not the only one. Further, the ULD encoders described in the above references suffer from a complex procedure for obtaining a constant data rate, particularly since an iteration loop is used, which has to be passed in order to determine, per sampling block, an amplification factor value adjusting a dequantizing step size.

SUMMARY

According to an embodiment, an apparatus for encoding an information signal into an encoded information signal may have a means for determining a representation of a psycho-perceptibility motivated threshold, which indicates a portion of the information signal irrelevant with regard to perceptibility, by using a perceptual model; a means for filtering the information signal for normalizing the information signal with regard to the psycho-perceptibility motivated threshold, for obtaining a prefiltered signal; a means for predicting the prefiltered signal in a forward-adaptive manner to obtain a predicted signal, a prediction error for the prefiltered signal and a representation of prediction coefficients, based on which the prefiltered signal can be reconstructed; and a means for quantizing the prediction error for obtaining a quantized prediction error, wherein the encoded information signal comprises information about the representation of the psycho-perceptibility motivated threshold, the representation of the prediction coefficients and the quantized prediction error.

According to another embodiment, an apparatus for decoding an encoded information signal comprising information about a representation of a psycho-perceptibility motivated threshold, a representation of prediction coefficients and a quantized prediction error into a decoded information signal may have a means for dequantizing the quantized prediction error for obtaining a dequantized prediction error; a means for determining a predicted signal based on the prediction coefficients; a means for reconstructing a prefiltered signal based on the predicted signal and the dequantized prediction error; and a means for filtering the prefiltered signal for reconverting a normalization with regard to the psycho-perceptibility motivated threshold for obtaining the decoded information signal.

According to another embodiment, a method for encoding an information signal into an encoded information signal, may have the steps of using a perceptibility model, determining a representation of a psycho-perceptibility motivated threshold indicating a portion of the information signal irrelevant with regard to perceptibility; filtering the information signal for normalizing the information signal with regard to the psycho-perceptibility motivated threshold for obtaining a prefiltered signal; predicting the prefiltered signal in a forward-adaptive manner to obtain a prefiltered signal, a prediction error to the prefiltered signal and a representation of prediction coefficients, based on which the prefiltered signal can be reconstructed; and quantizing the prediction error to obtain a quantized prediction error, wherein the encoded information signal comprises information about the representation of the psycho-perceptibility motivated threshold, the representation of the prediction coefficients and the quantized prediction error.

According to another embodiment, a method for decoding an encoded information signal comprising information about the representation of a psycho-perceptibility motivated threshold, a representation of prediction coefficients and a quantized prediction error into a decoded information signal may have the steps of dequantizing the quantized prediction error to obtain a dequantized prediction error; determining a predicted signal based on the prediction coefficient; reconstructing a prefiltered signal based on the predicted signal and the dequantized prediction error; and filtering the prefiltered signal for converting a normalization with regard to the psycho-perceptibility motivated threshold to obtain the decoded information signal.

Another embodiment may have a computer program with a program code for performing the inventive methods when the computer program runs on a computer.

According to another embodiment, an encoder may have an information signal input; a perceptibility threshold determiner operating according to a perceptibility model having an input coupled to the information signal input and a perceptibility threshold output; an adaptive prefilter comprising a filter input coupled to the information signal input, a filter output and a adaption control input coupled to the perceptibility threshold output, a forward prediction coefficient determiner comprising an input coupled to the prefilter output and a prediction coefficient output; a first subtractor comprising a first input coupled to the prefilter output, a second input and an output; a clipping and quantizing stage comprising a limited and constant number of quantizing levels, an input coupled to the subtractor output, a quantizing step size control input and an output; a step size adjuster comprising an input coupled to the output of the clipping and quantizing stage and a quantizing step size output coupled to the quantizing step size control input of the clipping and quantizing stage; a dequantizing stage comprising an input coupled to the output of the clipping/quantizing stage and a dequantizer control output; an adder comprising a first adder input coupled to the dequantizer output, a second adder input and an adder output; a prediction filter comprising a prediction filter input coupled to the adder output, a prediction filter output coupled to the second subtractor input as well as to the second adder input, as well as a prediction coefficient input coupled to the prediction coefficient output; an information signal generator comprising a first input coupled to the perceptibility threshold output, a second input coupled to the prediction coefficient output, a third input coupled to the output of the clipping and quantizing stage and an output representing an encoder output.

According to another embodiment, a decoder for decoding an encoded information signal comprising information about a representation of a psycho-perceptibility motivated threshold, prediction coefficients and a quantized prediction error, into a decoded information signal may have a decoder input; an extractor comprising an input coupled to the decoder input, a perceptibility threshold output, a prediction coefficient output and a quantized prediction error output; a dequantizer comprising a limited and constant number of quantizing levels, a dequantizer input coupled to the quantized prediction error output, a dequantizer output and a quantizing threshold control input; a backward-adaptive threshold adjuster comprising an input coupled to the quantized prediction error output, and an output coupled to the quantized threshold control input; an adder comprising a first adder input coupled to the dequantizer output, a second adder input and an adder output; a prediction filter comprising a precision filter input coupled to the adder output, a prediction filter output coupled to the second input, and a prediction filter coefficient input coupled to the prediction coefficient output; and an adaptive postfilter comprising a prediction filter input coupled to the adder output, a prediction filter output representing a decoder output, and an adaption control input coupled to the perceptibility threshold output.

The central idea of the present invention is the finding that extremely coarse quantization exceeding the measure determined by the masking threshold is made possible, without or only very little quality losses, by not directly quantizing the prefiltered signal but a prediction error obtained by forward-adaptive prediction of the prefiltered is. Due to the forward adaptivity, the quantizing error has no negative effect on the prediction coefficient.

According to a further embodiment, the prefiltered signal is even quantized in a nonlinear manner or even clipped, i.e. quantized via a quantizing function, which maps the unquantized values of the prediction error on quantizing indices of quantizing stages, and whose course is steeper below a threshold than above a threshold. Thereby, the noise PSD increased in relation to the masking threshold due to the low available bit rate adjusts to the signal PSD, so that the violation of the masking threshold does not occur at spectral parts without signal portion, which further improves the listening quality or maintains the listening quality, respectively, despite a decreasing available bit rate.

According to a further embodiment of the present invention, quantization is even quantized or limited, respectively, by clipping, namely by quantizing to a limited and fixed number of quantizing levels or stages, respectively. By prediction of the prefiltered signal via forward-adaptive prediction, the coarse quantization has no negative effect on the prediction coefficients themselves. By quantizing to a fixed number of quantizing levels, prevention of iteration for obtaining a constant bit rate is inherently enabled.

According to a further embodiment of the present invention, a quantizing step size or stage height, respectively, between the fixed number of quantizing levels is determined in a backward-adaptive manner from previous quantizing level indices obtained by quantization, so that, on the one hand, despite a very low number of quantizing levels, a better or at least best possible quantization of the prediction error or residual signal, respectively, can be obtained, without having to provide further side information to the decoder side. On the other hand, it is possible to ensure that transmission errors during transmission of the quantized residual signal to the decoder side only have a short-time effect on the decoder side with appropriate configuration of the backward-adaptive step size adjustment.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
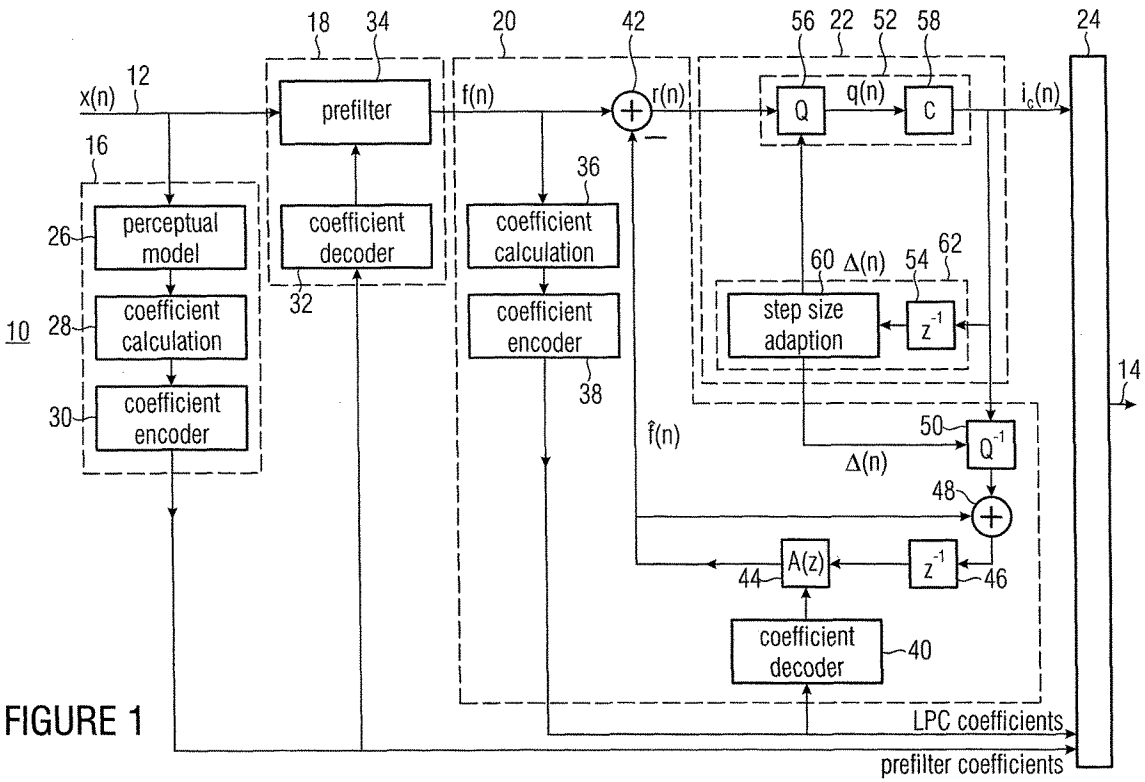
FIG. 1 is a block diagram of an encoder according to an embodiment of the present invention.

Before embodiments of the present invention will be discussed in more detail with reference to the drawings, first, for a better understanding of the advantages and principles of these embodiments, a possible implementation of an ULD-type encoding scheme will be discussed as comparative example, based on which the essential advantages and considerations underlying the subsequent embodiments, which have finally led to these embodiments, can be illustrated more clearly.

As has already been described in the introduction of the description, there is a need for an ULD version for lower bit rates of, for example, 64 k Bit/s, with comparable perceptual quality, as well as simpler scheme for obtaining a constant bit rate, particularly for intended lower bit rates. Additionally, it would be advantageous when the recovery time after a transmission error would remain low or at a minimum.

For redundancy reduction of the psychoacoustically preprocessed signal, the comparison ULD encoder uses a sample-wise backward-adaptive closed-loop prediction. This means that the calculation of prediction coefficients in encoder and decoder is based merely on past or already quantized and reconstructed signal samples. For obtaining an adaption to the signal or the prefiltered signal, respectively, a new set of predictor coefficients is calculated again for every sample. This results in the advantage that long predictors or prediction value determination formulas, i.e. particularly predictors having a high number of predictor coefficients can be used, since there is no requirement to transmit the predictor coefficients from encoder to decoder side. On the other hand, this means that the quantized prediction error has to be transmitted to the decoder without accuracy losses, for obtaining prediction coefficients that are identical to those underlying the encoding process. Otherwise, the predicted or predicated values, respectively, in the encoder and decoder would not be identical to each other, which would cause an instable encoding process. Rather, in the comparison ULD encoder, periodical reset of the predictor both on encoder and decoder side is necessitated to allow selective access to the encoded bit stream as well as to stop a propagation of transmission errors. However, the periodic resets cause bit rate peaks, which presents no problem for a channel with variable bit rate, but for channels with fixed bit rate where the bit rate peaks limit the lower limit of a constant bit rate adjustment.

As will result from the subsequent more detailed description of the ULD comparison encoding scheme with the embodiments of the present invention, these embodiments differ from the comparison encoding scheme by using a block-wise forward-adaptive prediction with a backward-adaptive quantizing step size adjustment instead of a sample-wise backward-adaptive prediction. On the one hand, this has the disadvantage that the predictors should be shorter in order to limit the amount of necessitated side information for transmitting the necessitated prediction coefficients towards the encoder side, which again might result in reduced encoder efficiency, but, on the other hand, this has the advantage that the procedure of the subsequent embodiments still functions effectively for higher quantizing errors, which are a result of reduced bit rates, so that the predictor on the decoder side can be used for quantizing noise shaping.

As will also result from the subsequent comparison, compared to the comparison ULD encoder, the bit rate is limited by limiting the range of values of the prediction remainder prior to transmission. This results in noise shaping modified compared to the comparison ULD encoding scheme, and also leads to different and less spurious listening artifacts. Further, a constant bit rate is generated without using iterative loops. Further, "reset" is inherently included for every sample block as result of the block-wise forward adaption. Additionally, in the embodiments described below, an encoding scheme is used for prefilter coefficients and forward prediction coefficients, which uses difference encoding with backward-adaptive quantizing step size control for an LSF (line spectral frequency) representation of the coefficients. The scheme provides block-wise access to the coefficients, generates a constant side information bit rate and is, above that, robust against transmission errors, as will be described below.

In the following, the comparison ULD encoder and decoder structure will be described in more detail, followed by the description of embodiments of the present invention and the illustration of its advantages in the transmission from higher constant bit rates to lower bit rates.

In the comparison ULD encoding scheme, the input signal of the encoder is analyzed on the encoder side by a perceptual model or listening model, respectively, for obtaining information about the perceptually irrelevant portions of the signal. This information is used to control a prefilter via time-varying filter coefficients. Thereby, the prefilter normalizes the input signal with regard to its masking threshold. The filter coefficients are calculated once for every block of 128 samples each, quantized and transmitted to the encoder side as side information.

After multiplication of the prefiltered signal with an amplification factor by subtracting the backward-adaptive predicted signal, the prediction error is quantized by a uniform quantizer, i.e. a quantizer with uniform step size. As already mentioned above, the predicted signal is obtained via sample-wise backward-adaptive closed-loop prediction. Accordingly, no transmission of prediction coefficients to the decoder is necessitated.Subsequently, the quantized prediction residual signal is entropy encoded. For obtaining a constant bit rate, a loop is provided, which repeats the steps of multiplication, prediction, quantizing and entropy-encoding several times for every block of prefiltered samples. After iteration, the highest amplification factor of a set of predetermined amplification values is determined, which still fulfills the constant bit rate condition. This amplification value is transmitted to the decoder. If, however, an amplification value smaller than one is determined, the quantizing noise is perceptible after decoding, i.e. its spectrum is shaped similar to the masking threshold, but its overall power is higher than predetermined by the prediction model. For portions of the input signal spectrum, the quantizing noise could even get higher than the input signal spectrum itself, which again generates audible artifacts in portions of the spectrum, where otherwise no audible signal would be present, due to the usage of a predictive encoder. The effects caused by quantizing noise represent a limiting factor when lower constant bit rates are of interest.

Continuing with the description of the comparison ULD scheme, the prefilter coefficients are merely transmitted as intraframe LSF differences, and also only as soon as the same exceed a certain limit. For avoiding transmission error propagation for an unlimited period, the system is reset from time to time. Additional techniques can be used for minimizing a decrease in perception of the decoded signal in the case of transmission errors. The transmission scheme generates a variable side information bit rate, which is leveled in the above-described loop by adjusting the above-mentioned amplification factor accordingly.

The entropy encoding of the quantized prediction residual signal in the case of the comparison ULD encoder comprises methods, such as a Golomb, Huffman, or arithmetic encoding method. The entropy encoding has to be reset from time to time and generates inherently a variable bit rate, which is again leveled by the above-mentioned loop.

In the case of the comparison ULD encoding scheme, the quantized prediction residual signal in the decoder is obtained from entropy encoding, whereupon the prediction remainder and the predicted signal are added, the sum is multiplied with the inverse of the transmitted amplification factor, and therefrom, the reconstructed output signal is generated via the postfilter having a frequency response inverse to the one of the prefilter, wherein the postfilter uses the transmitted prefilter coefficients.

A comparison ULD encoder of the just described type obtains, for example, an overall encoder/decoder delay of 5.33 to 8 ms at sample frequencies of 32 kHz to 48 kHz. Without (spurious loop) iterations, the same generates bit rates in the range of 80 to 96 kBit/s. As described above, at lower constant bit rates, the listening quality is decreased in this encoder, due to the uniform increase of the noise spectrum. Additionally, due to the iterations, the effort for obtaining a uniform bit rate is high. The embodiments described below overcome or minimize these disadvantages. At a constant transmission data rate, the encoding scheme of the embodiments described below causes altered noise shaping of the quantizing error and necessitates no iteration. More precisely, in the above-discussed comparison ULD encoding scheme, in the case of constant transmission data rate in an iterative process, a multiplicator is determined, with the help of which the signal coming from the prefilter is multiplied prior to quantizing, wherein the quantizing noise is spectrally white, which causes a quantizing noise in the decoder which is shaped like the listening threshold, but which lies slightly below or slightly above the listening threshold, depending on the selected multiplicator, which can, as described above, also be interpreted as a shift of the determinedlistening threshold. In connection therewith, quantizing noise results after decoding, whose power in the individual frequency domains can even exceed the power of the input signal in the respective frequency domain. The resulting encoding artifacts are clearly audible. The embodiments described below shape the quantizing noise such that its spectral power density is no longer spectrally white. The coarse quantizing/limiting or clipping, respectively, of the prefilter signal rather shapes the resulting quantizing noise similar to the spectral power density of the prefilter signal. Thereby, the quantizing noise in the decoder is shaped such that it remains below the spectral power density of the input signal. This can be interpreted as deformation of the determined listening threshold. The resulting encoding artifacts are less spurious than in the comparison ULD encoding scheme. Further, the subsequent embodiments necessitate no iteration process, which reduces complexity.

Since by describing the comparison ULD encoding scheme above, a sufficient base has been provided for turning the attention to the underlying advantages and considerations of the following embodiments for the description of these embodiments, first, the structure of an encoder according to an embodiment of the present invention will be described below.

The encoder of FIG. 1, generally indicated by 10, comprises an input 12 for the information signal to be encoded, as well as an output 14 for the encoded information signal, wherein it is exemplarily assumed below that this is an audio signal, and exemplarily particularly an already sampled audio signal, although sampling within the encoder subsequent to the input 12 would also be possible. Samples of the incoming output signal are indicated by x(n) in FIG. 1.

As shown in FIG. 1, the encoder 10 can be divided into a masking threshold determination means 16, a prefilter means 18, a forward-predictive prediction means 20 and a quantizing/clip means 22 as well as bit stream generation means 24. The masking threshold determination means 16 operates according to a perceptual model or listening model, respectively, for determining a representation of the masking or listening threshold, respectively, of the audio signal incoming at the input 12 by using the perceptual model, which indicates a portion of the audio signal that is irrelevant with regard to the perceptibility or audibility, respectively, or represents a spectral threshold for the frequency at which spectral energy remains inaudible due to psychoacoustic covering effects or is not perceived by humans, respectively. As will be described below, the determining means 16 determines the masking threshold in a block-wise manner, i.e. the same determines a masking threshold per block of subsequent blocks of samples of the audio signal. Other procedures would also be possible. The representation of the masking threshold as it results from the determination means 16 can, in contrary to the subsequent description, particularly with regard to FIG. 4, also be a representation by spectral samples of the spectral masking threshold.

The prefilter or preestimation means 18 is coupled to both the masking threshold determination means 16 and the input 12 and filters the output signal for normalizing the same with regard to the masking threshold for obtaining a prefiltered signal f(n). The prefilter means 18 is based, for example, on a linear filter and is implemented to adjust the filter coefficients in dependence on the representation of the masking threshold provided by the masking threshold of the determination means 16, such that the transmission function of the linear filter corresponds substantially to the inverse of the masking threshold. Adjustment of the filter coefficients can be performed block-wise, half block-wise, such as in the case described below of the blocks overlapping by half in the masking threshold determination, or sample-wise, for example by interpolating the filter coefficients obtained by the block-wise determined masking threshold representations, or by filter coefficients obtained therefrom across the interblock gaps.

The forward prediction means 20 is coupled to the prefilter means 18,for subjecting the samples f(n) of the prefiltered signal, which are filtered adaptively in the time domain by using the psychoacoustic masking threshold to a forward-adaptive prediction, for obtaining a predicted signal $\hat{f}(n)$, a residual signal r(n) representing a prediction error to the prefiltered signal f(n), and a representation of prediction filter coefficients, based on which the predicted signal can be reconstructed. Particularly, the forward-adaptive prediction means 20 is implemented to determine the representation of the prediction filter coefficients immediately from the prefiltered signal f and not only based on a subsequent quantization of the residual signal r. Although, as will be discussed in more detail below with reference to FIG. 4, the prediction filter coefficients are represented in the LSF domain, in particular in the form of a LSF prediction residual, other representations, such as an intermediate representation in the shape of linear filter coefficients, are also possible. Further, means 20 performs the prediction filter coefficient determination according to the subsequent description exemplarily block-wise, i.e. per block in subsequent block of samples f(n) of the prefiltered signal, wherein, however, other procedures are also possible. Means 20 is then implemented to determine the predicted signal $\hat{f}$ via these determined prediction filter coefficients, and to subtract the same from the prefiltered signal f, wherein the determination of the predicted signal is performed, for example, via a linear filter, whose filter coefficients are adjusted according to the forward-adaptivelydetermined prediction coefficient representations. The residual signal available on the decoder side, i.e. the quantized and clipped residual signal $i_c(n)$, added to previously output filter output signal values, can serve as filter input signal, as will be discussed below in more detail.

The quantizing/clip means 22 is coupled to the prediction means 20, for quantizing or clipping, respectively, the residual signal via a quantizing function mapping the values r(n) of the residual signal to a constant and limited number of quantizing levels, and for transmitting the quantized residual signal obtained in that way in the shape of the quantizing indices $i_c(n)$, as has already been mentioned, to the forward-adaptive prediction means 20.

The quantized residual signal $i_c(n)$, the representation of the prediction coefficients determined by the means 20, as well as the representation of the masking threshold determined by the means 16 make up information provided to the decoder side via the encoded signal 14, wherein therefore the bit stream generation means 24 is provided exemplarily in FIG. 1, for combining the information according to a serial bit stream or a packet transmission, possibly by using a further lossless encoding.

Before the more detailed structure of the encoder of FIG. 1 will be discussed, the mode of operation of the encoder 1 will be described below based on the above structure of the encoder 10. By filtering the audio signal by the prefilter means 18 with a transmission function corresponding to the inverse of the masking threshold, a prefiltered signal f(n) results, which obtains a spectral power density of the error by uniform quantizing, which mainly corresponds to a white noise, and would result in a noise spectrum similar to the masking threshold by filtering in the postfilter on the decoder side. However, first, the residual signal f is reduced to a prediction error r by the forward-adaptiveprediction means 20 by a forward adapted predicted signal $\hat{f}$ by subtraction. The subsequent coarse quantization of this prediction error r by the quantizing/clipping means 22 has no effect on the prediction coefficients of the prediction means 20, neither on the encoder nor the decoder side, since the calculation of the prediction coefficients is performed in a forward-adaptive manner and thus based on the unquantized values f(n). Quantization is not only performed in a coarse way, in the sense that a coarse quantizing step size is used, but is also performed in a coarse manner in the sense that even quantization is performed only to a constant and limited number of quantizing levels, so that for representing every quantized residual signal $i_c(n)$ or every quantizing index in the encoded audio signal 14 only a fixed number of bits is necessitated, which allows inherently a constant bit rate with regard to the residual values $i_c(n)$. As will be described below, quantization is performed mainly by quantizing to uniformly spaced quantizing levels of fixed number, and below exemplarily to a number of a merely three quantizing levels, wherein quantization is performed, for example, such that an unquantized residual signal value r(n) is quantized to the next quantizing level, for obtaining the quantizing index $i_c(n)$ of the corresponding quantizing level for the same. Extremely high and extremely low values of the unquantized residual signal r(n) are thus mapped to the respective highest or lowest, respectively, quantizing level or the respective quantizing level index, respectively, even when they would be mapped to a higher quantizing level at uniform quantizing with the same step size. In so far, the residual signal r is also "clipped" or limited, respectively, by the means 22. However, the latter has the effect, as will be discussed below, that the error PSD (PSD =power spectral density) of the prefiltered signal is no longer a white noise, but is approximated to the signal PSD of the prefiltered signal depending on the degree of clipping. On the decoder side, this has the effect that the noise PSD remains below the signal PSD evenat bit rates that are lower than predetermined by the masking threshold.

In the following, the structure of the encoder in FIG. 1 will be described in more detail. Particularly, the masking threshold determination means 16 comprises a masking threshold determiner or a perceptual model 26, respectively, operating according to the perceptual model, a prefilter coefficient calculation module 28 and a coefficient encoder 30, which are connected in the named order between the input 12 and the prefilter means 18 as well as the bit stream generator 24. The prefilter means 18 comprises a coefficient decoder 32 whose input is connected to the output of the coefficient encoder 30, as well as the prefilter 34, which is, for example, an adaptive linear filter, and which is connected with its data input to the input 12 and with its data output to the means 20, while its adaption input for adapting the filter coefficients is connected to an output of the coefficient decoder 32. The prediction means 20 comprises a prediction coefficient calculation module 36, a coefficient encoder 38, a coefficient decoder 40, a subtractor 42, a prediction filter 44, a delay element 46, a further adder 48 and a dequantizer 50. The prediction coefficient calculation module 46 and the coefficient encoder 38 are connected in series in this order between the output of the prefilter 34 and the input of the coefficient decoder 40 or a further input of the bit stream generator 24, respectively, and cooperate for determining a representation of the prediction coefficients block-wise in a forward-adaptive manner. The coefficient decoder 40 is connected between the coefficient encoder 38 and the prediction filter 44, which is, for example, a linear prediction filter. Apart from the prediction coefficient input connected to the coefficient decoder 40, the filter 44 comprises a data input and a data output, to which the same is connected in a closed loop, which comprises, apart from the filter 44, the adder 48 and the delay element 46. Particularly, the delay element 46 is connected between the adder 48 and the filter 44, while the data output of the filter 44 is connected to a first input of the adder 48. Above that, the data output of the filter 44 is also connected to an inverting input of the subtractor 42. A non-inverting input of the subtractor 42 is connected to the output of the prefilter 34, while the second input of the adder 48 is connected to an output of the dequantizer 50. A data input of the dequantizer 50 is coupled to the quantizing/clipping means 22 as well as to a step size control input of the dequantizer 50. The quantizing/clipping means 22 comprises a quantizer module 52 as well as a step size adaption block 54, wherein again the quantizing module 52 consists of a uniform quantizer 56 with uniform and controllable step size and a limiter 58, which are connected in series in the named order between an output of the subtractor 42 and the further input of the bit stream generator 24, and wherein the step size adaption block 54 again comprises a step size adaption module 60 and a delay member 62, which are connected in series in the named order between the output of the limiter 58 and a step size control input of the quantizer 56. Additionally, the output of the limiter 58 is connected to the data input of the dequantizer 50, wherein the step size control input of the dequantizer 50 is also connected to the step size adaption block 60. An output of the bit stream generator 24 again forms the output 14 of the encoder 10.

After the detailed structure of the encoder of FIG. 1 has been described in detail above, its mode of operation will be described below. The perceptual model module 26 determines or estimates, respectively, the masking threshold in a block-wise manner from the audio signal. Therefore, the perceptual model module 26 uses, for example, a DFT of the length 256, i.e. a block length of 256 samples x(n), with 50% overlapping between the blocks, which results in a delay of the encoder 10 of 128 samples of the audio signal. The estimation of the masking threshold output by the perceptual model module 26 is, for example, represented in a spectrally sampled form in a Bark band or linear frequency scale. The masking threshold output per block by the perceptual model module 26 is used in the coefficient calculation module 24 for calculating filter coefficients of a predetermined filter, namely the filter 34. The coefficients calculated by the module 28 can, for example, be LPC coefficients, which model the masking threshold. The prefilter coefficients for every block are again encoded by the coefficient encoder 30, which will be discussed in more detail with reference to FIG. 4. The coefficient decoder 34 decodes the encoded prefilter coefficients for retrieving the prefilter coefficients of the module 28, wherein the prefilter 34 again obtains these parameters or prefilter coefficients, respectively, and uses the same, so that it normalizes the input signal x(n) with regard to its masking threshold or filters the same with a transmission function, respectively, which essentially corresponds to the inverse of the masking threshold. Compared to the input signal, the resulting prefiltered signal f(n) is significantly smaller in amount.

In the prediction coefficient calculation module 36, the samples f(n) of the prefiltered signal are processed in a block-wise manner, wherein the block-wise division can correspond exemplarily to the one of the audio signal 12 by the perceptual model module 26, but does not have to do this. For every block of prefiltered samples, the coefficient calculation module 36 calculates prediction coefficients for usage by the prediction filter 44. Therefore, the coefficient calculation module 36 performs, for example, LPC (LPC=linear predictive coding) analysis per block of the prefiltered signal for obtaining the prediction coefficients. The coefficient encoder 38 encodes then the prediction coefficients similar to the coefficient encoder 30, as will be discussed in more detail below, and outputs this representation of the prediction coefficients to the bit stream generator 24 and particularly the coefficient decoder 40, wherein the latter uses the obtained prediction coefficient representation for applying the prediction coefficients obtained in the LPC analysis by the coefficient calculation module 36 to the linear filter 44, so that the closed loop predictor consisting of the closed loop of filter 44, delay member 46 and adder 48 generates the predicted signal $\hat{f}(n)$, which is again subtracted from the prefiltered signal f(n) by the subtractor 42. The linear filter 44 is, for example, a linear prediction filter of the type $A(z)=\Sigma_{i=1}^{n} a_i z^{-i}$ of the length N, wherein the coefficient decoder 40 adjusts the values $a_i$ in dependence on the prediction coefficients calculated by the coefficient calculation module 36, i.e. the weightings with which the previous predicted values $\hat{f}(n)$ plus the dequantized residual signal values are weighted and then summed for obtaining the new or current, respectively, predicted value $\hat{f}$ The prediction remainder r(n) obtained by the subtractor 42 is subject to uniform quantization, i.e. quantization with uniform quantizing step size, in the quantizer 56, wherein the step size Δ(n) is time-variable, and is calculated or determined, respectively, by the step size adaption module in a backward-adaptive manner, i.e. from the quantized residual values to the previous residual values r(m<n). More precisely, the uniform quantizer 56 outputs a quantized residual value q(n) per residual value r(n), which can be expressed as $q(n)=i(n)\cdot\Delta(n)$ and can be referred to as provisional quantizing step with index. The provisional quantizing index i(n) is again clipped by the limiter 58, to the amount C=[−c;c], wherein c is a constant $c\in\{1, 2, \ldots\}$. Particularly, the limiter 58 is implemented such that all provisional index values i(n) with |i(n)|>c are either set to −c or c, depending on which is closer. Merely the clipped or limited, respectively, index sequence or series $i_c(n)$ is output by the limiter 58 to the bit stream generator 24, the dequantizer 50 and the step size adaption block 54 or the delay element 62, respectively, because the delay member 62, as well as all other delay members in the present embodiments, delays the incoming values by one sample.

Now, backward-adaptive step size control is realized via the step size adaption block 54, in that the same uses past index sequence values $i_c(n)$ delayed by the delay member 62 for constantly adapting the step size Δ(n), such that the area limited by the limiter 58, i.e. the area set by the "allowed" quantizing indices or the corresponding quantizing levels, respectively, is placed such to the statistic probability of occurrence of unquantized residual values r(n), that the allowed quantizing levels occur as uniformly as possible in the generated clipped quantizing index sequence stream $i_c(n)$. Particularly, the step size adaption module 60 calculates, for example, the current step size Δ(n) for example by using the two immediately preceding clipped quantizing indices $i_c(n-1)$ and $i_2(n-2)$ as well as the immediately previously determined step size value Δ(n−1) to $\Delta(n)=\beta\Delta(n-1)+\delta(n)$, with $\beta\in[0.0;1.0[$, $\delta(n)=\delta_0$ for $|i_c(n-1)+i_c(n-2)|\leq I$ and $\delta(n)=\delta_1$ for $|i_c(n-1)+i_c(n-2)|>I$, wherein $\delta_0$, $\delta_1$ and I are appropriately adjusted constants, as well as β.

As will be discussed in more detail below with reference to FIG. 5, the decoder uses the obtained quantizing index sequence $i_c(n)$ and the step size sequence Δ(n), which is also calculated in a backward-adaptive manner for reconstructing the dequantized residual value sequence $q_c(n)$ by calculating $i_c(n)\cdot\Delta(n)$, which is also performed in the encoder 10 of FIG. 1, namely by the dequantizer 50 in the prediction means 20. Like on the decoder side, the residual value sequence $q_c(n)$ constructed in that way is subject to an addition with the predicted values $\hat{f}(n)$ in a sample-wise manner, wherein the addition is performed in the encoder 10 via the adder 48. While the reconstructed or dequantized, respectively, prefiltered signal obtained in that way is no longer used in the encoder 10, except for calculating the subsequent predicted values $\hat{f}(n)$, the postfilter generates the decoded audio sample sequence y(n) therefrom on the decoder side, which cancels the normalization by the prefilter 34.

Figure 2:
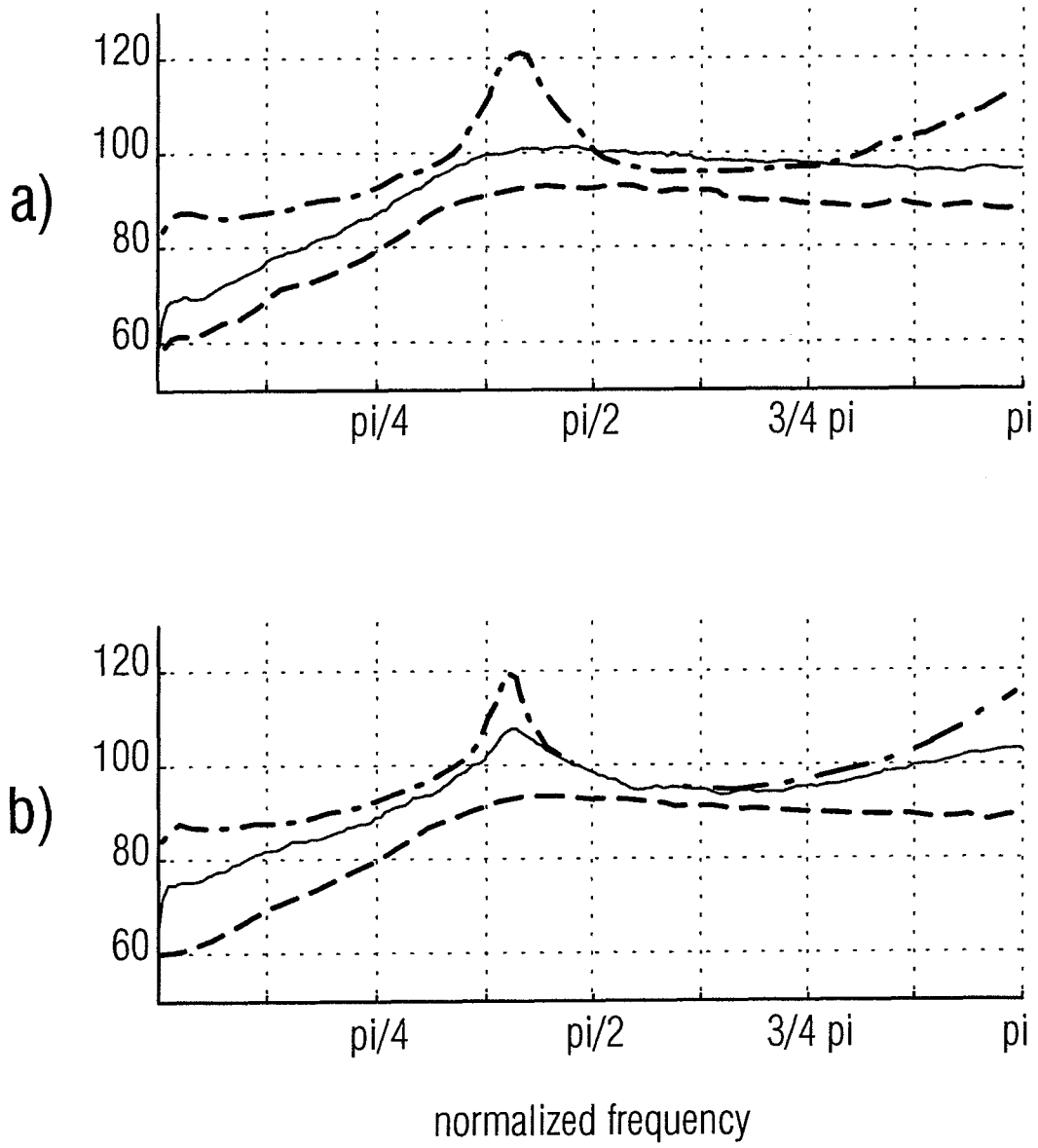
FIGS. 2*a/b* are graphs showing exemplarily the course of the noise spectrum in relation to the masking threshold and signal power spectrum density for the case of the encoder according to claim 1 (graph a) or for a comparative case of an encoder with backward-adaptive prediction of the prefiltered signal and iterative and masking threshold block-wise quantizing step size adjustment (graph b), respectively.
Figure 3:
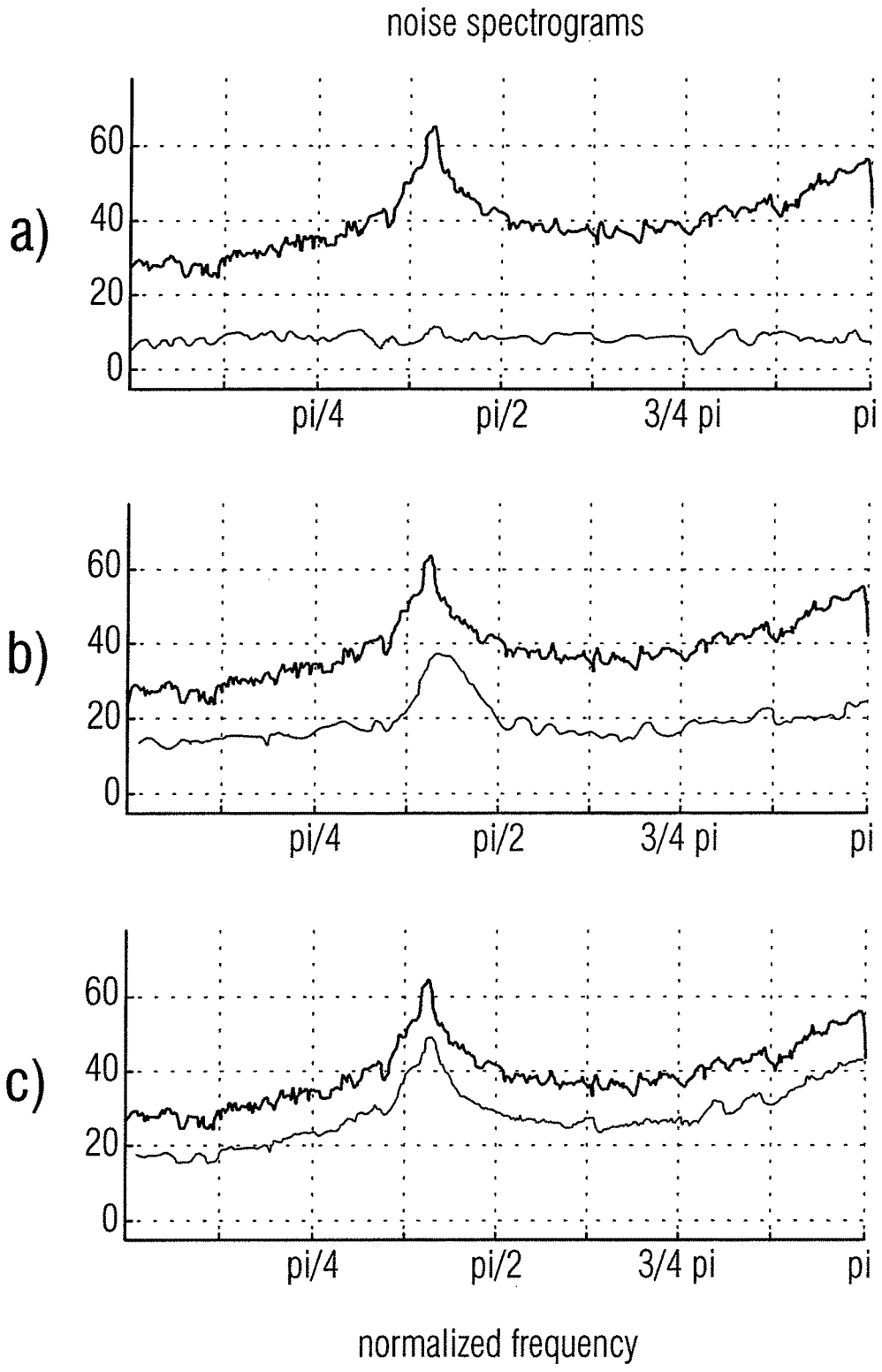
FIGS. 3*a*/3*b* and 3*c* are graphs showing exemplarily the signal power spectrum density in relation to the noise or error power spectrum density, respectively, for different clip extensions or different numbers of quantizing levels, respectively, for the case that, like in the encoder of FIG. 1, forward-adaptive prediction of the prefiltered signal but still an iterative quantizing step size adjustment is performed.

The quantizing noise introduced in the quantizing index sequence $q_c(n)$ is no longer white due to the clipping. Rather, its spectral form copies the one of the prefiltered signal. For illustrating this, reference is briefly made to FIG. 3, which shows, in graphs a, b and c, the PSD of the prefiltered signal (upper graph) and the PSD of the quantizing error (respective lower graph) for different numbers of quantizing levels or stages, respectively, namely for C=[−15;15] in graph a, for a limiter range of [−7;7] in graph b, and a clipping range of [−1;1] in graph c. For clarity reasons, it should further be noted that the PSD courses of the error PSDs in graphs A-C have each been plotted with an offset of −10 dB. As can be seen, the prefiltered signal corresponds to a colored noise with a power of $\sigma^2=34$. At a quantization with a step size $\Delta=1$, the signal lies within [−21;21], i.e. the samples of the prefiltered signal have an occurrence distribution or form a histogram, respectively, which lies within this domain. For graphs a to c in FIG. 3, the quantizing range has been limited, as mentioned, to [−15;15] in a), [−7;7] in b) and [−1;1] in c). The quantizing error has been measured as the difference between the unquantized prefiltered signal and the decoded prefiltered signal. As can be seen, a quantizing noise is added to the prefiltered signal by increasing clipping or with increasing limitation of the number of quantizing levels, which copies the PSD of the prefiltered signal, wherein the degree of copying depends on the hardness or the extension, respectively, of the applied clipping. Consequently, after postfiltering, the quantizing noise spectrum on the decoder side copies more the PSD of the audio input signal. This means that the quantizing noise remains below the signal spectrum after decoding. This effect is illustrated in FIG. 2, which shows in graph a, for the case of backward-adaptive prediction, i.e. prediction according to the above described comparison ULD scheme, and in graph b, for the case of forward-adaptive prediction with applied clipping according to FIG. 1, respectively three courses in a normalized frequency domain, namely, from top to bottom, the signal PSD, i.e. the PSD of the audio signal, the quantizing error PSD or the quantizing noise after decoding (straight line) and the masking threshold (dotted line). As can be seen, the quantizing noise for the comparison ULD encoder (FIG. 2*a*) is formed like the masking threshold and exceeds the signal spectrum for portions of the signal. The effect of the forward-adaptive prediction of the prefiltered signal combined with subsequent clipping or limiting, respectively, of the quantizing level number is now clearly illustrated in FIG. 2*b*, where it can be seen that the quantizing noise is lower than the signal spectrum and its shape represents a mixture of the signal spectrum and the masking threshold. In listening tests, it has been found out that the encoding artifacts according to FIG. 2*b* are less spurious, i.e. the perceived listening quality is better.

The above description of the mode of operation of the encoder of FIG. 1 concentrated on the postprocessing of the prefiltered signal f(n), for obtaining the clipped quantizing indices $i_c(n)$ to be transmitted to the decoder side. Since they originate from an amount with a constant and limited number of indices, they can each be represented with the same number of bits within the encoded data stream at the output 14. Therefore, the bit stream generator 24 uses, for example, an infective mapping of the quantizing indices to m bit words that can be represented by a predetermined number of bits m.

The following description deals with the transmission of the prefilter or prediction coefficients, respectively, calculated by the coefficient calculation modules 28 and 36 to the decoder side, i.e. particularly with an embodiment for the structure of the coefficient encoders 30 and 38.

Figure 4:
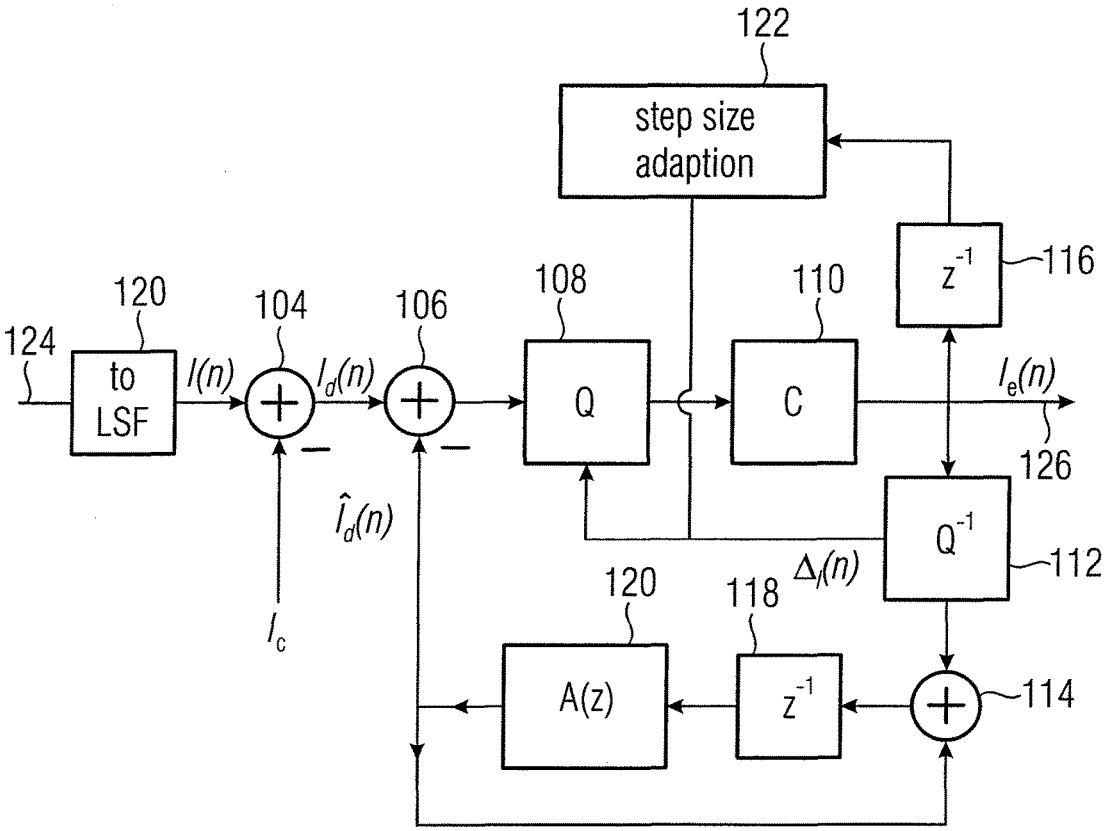
FIG. 4 is a block diagram of a structure of the coefficient encoder in the encoder of FIG. 1 according to an embodiment of the present invention.

As is shown, the coefficient encoders according to the embodiment of FIG. 4 comprise an LSF conversion module 102, a first subtractor 104, a second subtractor 106, a uniform quantizer 108 with uniform and adjustable quantizing step size, a limiter 110, a dequantizer 112, a third adder 114, two delay members 116 and 118, a prediction filter 120 with fixed filter coefficients or constant filter coefficients, respectively, as well as a step size adaption module 122. The filter coefficients to be encoded come in at an input 124, wherein an output 126 is provided for outputting the encoded representation.

An input of the LSF conversion module 102 directly follows the input 124. The subtractor 104 with its non-inverting input and its output is connected between the output of the LSF conversion module 102 and a first input of the subtractor 106, wherein a constant $l_c$ is applied to the input of the subtractor 104. The subtractor 106 is connected with its non-inverting input and its output between the first subtractor 104 and the quantizer 108, wherein its inverting input is coupled to an output of the prediction filter 120. Together with the delay member 118 and the adder 114, the prediction filter 120 forms a closed-loop predictor, in which the same are connected in series in a loop with feedback, such that the delay member 118 is connected between the output of the adder 114 and the input of the prediction filter 120, and the output of the prediction filter 120 is connected to a first input of the adder 114. The remaining structure corresponds again mainly to the one of the means 22 of the encoder 10, i.e. the quantizer 108 is connected between the output of the subtractor 106 and the input of the limiter 110, whose output is again connected to the output 126, an input of the delay member 116 and an input of the dequantizer 112. The output of the delay member 116 is connected to an input of the step size adaption module 122, which thus form together a step size adaption block. An output of the step size adaption module 122 is connected to step size control inputs of the quantizer 108 and the dequantizer 112. The output of the dequantizer 112 is connected to the second input of the adder 114.

After the structure of the coefficient encoder has been described above, its mode of operation will be described below, wherein reference is made again to FIG. 1. The transmission of both the prefilters and the prediction or predictor coefficients, respectively, or their encoding, respectively, is performed by using a constant bit rate encoding scheme, which is realized by the structure according to FIG. 4. Then, in the LSF conversion module 102, the filter coefficients, i.e. the prefilter or prediction coefficients, respectively, are first converted to LSF values l(n) or transferred to the LSF domain, respectively. Every spectral line frequency l(n) is then processed by the residual elements in FIG. 4 as follows. This means the following description relates to merely one spectral line frequency, wherein the processing of course, is performed for all spectral line frequencies. For example, the module 102 generates LSF values for every set of prefilter coefficients representing a masking threshold, or a block of prediction coefficients predicting the prefiltered signal. The subtractor 104 subtracts a constant reference value $l_c$ from the calculated value l(n), wherein a sufficient range for $l_c$ ranges, for example, from 0 to π. From the resulting difference $l_d(n)$, the subtractor 106 subtracts a predicted value $\hat{l}_d(n)$, which is calculated by the closed-loop predictor 120, 118 and 114 including the prediction filter 120, such as a linear filter, with fixed coefficients A(z). What remains, i.e. the residual value, is quantized by the adaptive step size quantizer 108, wherein the quantizing indices output by the quantizer 108 are clipped by the limiter 110 to a subset of the quantizing indices received by the same, such as, for example, that for all clipped quantizing indices $l_e(n)$, as they are output by the limiter 110, the following applies: $\forall: l_e(n) \in \{-1,0,1\}$. For quantizing step size adaption of Δ(n) of the LSF residual quantizer 108, the step size adaption module 122 and the delay member 116 cooperate for example in the way described with regard to the step size adaption block 54 with reference to FIG. 1, however, possibly with a different adaption function or with different constants β, I, $\delta_0$, $\delta_1$ and I. While the quantizer 108 uses the current step size for quantizing the current residual value to $l_e(n)$, the dequantizer 112 uses the step size $\Delta_l(n)$ for dequantizing this index value $l_e(n)$ again and for supplying the resulting reconstructed value for the LSF residual value, as it has been output by the subtractor 106, to the adder 114, which adds this value to the corresponding predicted value $\hat{l}_d(n)$, and supplies the same via the delay member 118 delayed by a sample to the filter 120 for calculating the predicted LSF value $\hat{l}_d(n)$ for the next LSF value $l_d(n)$.

If the two coefficient encoders 30 and 38 are implemented in the way described in FIG. 4, the coder 10 of FIG. 1 fulfills a constant bit rate condition without using any loop. Due to the block-wise forward adaption of the LPC coefficients and the applied encoding scheme, no explicit reset of the predictor is necessitated.

Before results of listening tests, which have been obtained by an encoder according to FIGS. 1 and 4, will be discussed below, the structure of a decoder according to an embodiment of the present invention will be described below, which is suitable for decoding an encoded data stream from this encoder, wherein reference is made to FIGS. 5 and 6. FIG. 6 also shows the structure of the coefficient decoder in FIG. 1.

Figure 5:
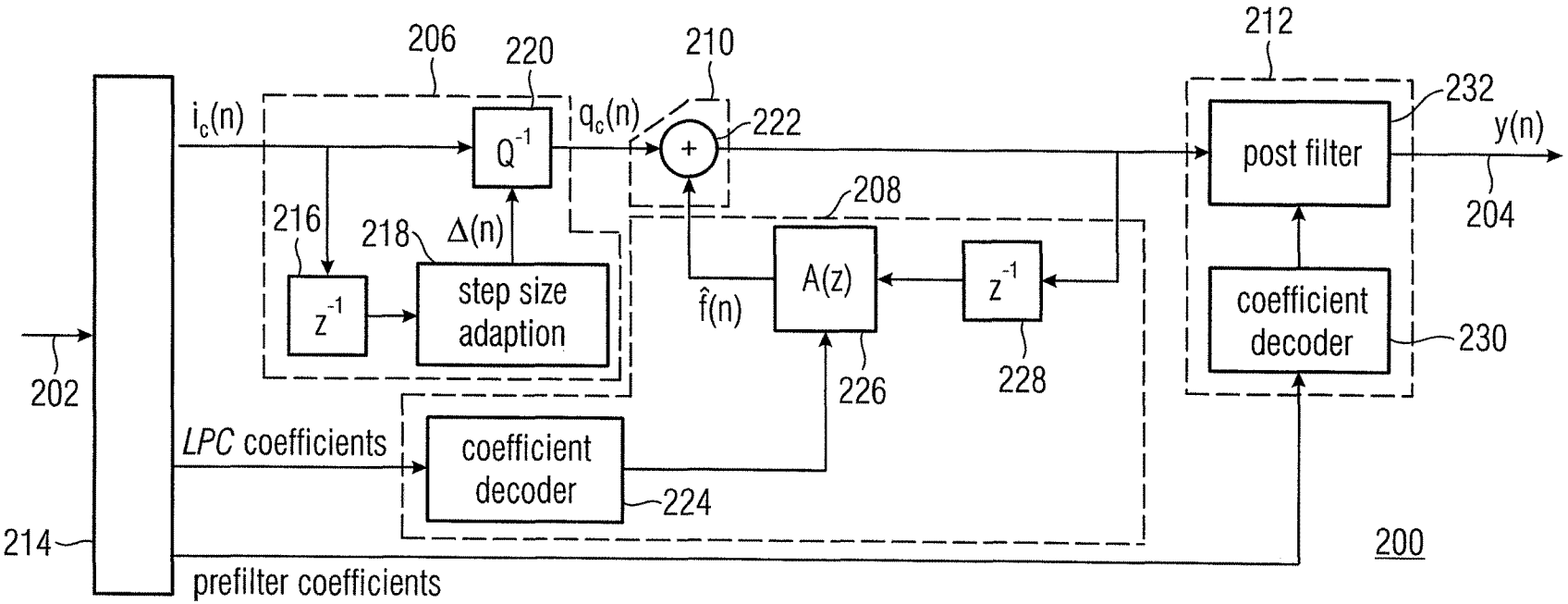
FIG. 5 is a block diagram of a decoder for decoding an information signal encoded by the encoder of FIG. 1 according to an embodiment of the present invention.
Figure 6:
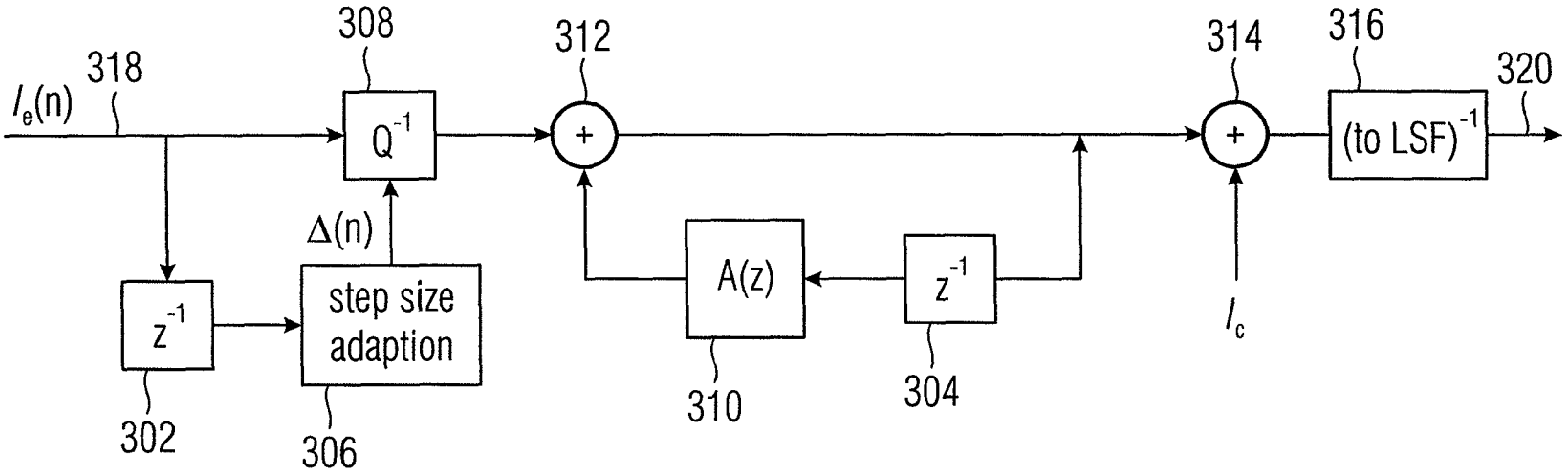
FIG. 6 is a block diagram of a structure of the coefficient encoders in the encoder of FIG. 1 or the decoder of FIG. 5 according to an embodiment of the present invention.

The decoder generally indicated by 200 in FIG. 5 comprises an input 202 for receiving the encoded data stream, an output 204 for outputting the decoded audio stream y(n) as well as a dequantizing means 206 having a limited and constant number of quantizing levels, a prediction means 208, a reconstruction means 210 as well as a postfilter means 212. Additionally, an extractor 214 is provided, which is coupled to the input 202 and implemented to extract, from the incoming encoded bit stream, the quantized and clipped prefilter residual signal $i_c(n)$, the encoded information about the prefilter coefficients and the encoded information about the prediction coefficients, as they have been generated from the coefficient encoders 30 and 38 (FIG. 1) and to output the same at the respective outputs. The dequantizing means 206 is coupled to the extractor 214 for obtaining the quantizing indices $i_c(n)$ from the same and for performing dequantization of these indices to a limited and constant number of quantizing levels, namely—sticking to the same notation as above—$\{-c\cdot\Delta(n);\ c\cdot\Delta(n)\}$, for obtaining a dequantized or reconstructed prefilter signal $q_c(n)$, respectively. The prediction means 208 is coupled to the extractor 214 for obtaining a predicted signal for the prefiltered signal, namely $\hat{f}_c(n)$ from the information about the prediction coefficients. The prediction means 208 is coupled to the extractor 214 for determining a predicted signal for the prefiltered signal, namely $\hat{f}(n)$, from the information about the prediction coefficients, wherein the prediction means 208 according to the embodiment of FIG. 5 is also connected to an output of the reconstruction means 210. The reconstruction means 210 is provided for reconstructing the prefiltered signal, based on the predicted signal $\hat{f}(n)$ and the dequantized residual signals $q_c(n)$. This reconstruction is then used by the subsequent postfilter means 212 for filtering the prefiltered signal based on the prefilter coefficient information received from the extractor 214, such that the normalization with regard to the masking threshold is canceled for obtaining the decoded audio signal y(n).

After the basic structure of the decoder of FIG. 5 has been described above, the structure of the decoder 200 will be discussed in more detail. Particularly, the dequantizer 206 comprises a step size adaption block of a delay member 216 and a step size adaption module 218 as well as a uniform dequantizer 220. The dequantizer 220 is connected to an output of the extractor 214 with its data input, for obtaining the quantizing indices $i_c(n)$. Further, the step size adaption module 218 is connected to this output of the extractor 214 via the delay member 216, whose output is again connected to a step size control input of the dequantizer 220. The output of the dequantizer 220 is connected to a first input of the adder 222, which forms the reconstruction means 210. The prediction means 208 comprises a coefficient decoder 224, a prediction filter 226 as well as delay member 228. Coefficient decoder 224, adder 222, prediction filter 226 and delay member 228 correspond to elements 40, 44, 46 and 48 of the encoder 10 with regard to their mode of operation and their connectivity. In particular, the output of the prediction filter 226 is connected to the further input of the adder 222, whose output is again fed back to the data input of the prediction filter 226 via the delay member 228, as well as coupled to the postfilter means 212. The coefficient decoder 224 is connected between a further output of the extractor 214 and the adaption input of the prediction filter 226. The postfilter means comprises a coefficient decoder 230 and a postfilter 232, wherein a data input of the postfilter 232 is connected to an output of the adder 222 and a data output of the postfilter 232 is connected to the output 204, while an adaption input of the postfilter 232 is connected to an output of the coefficient decoder 230 for adapting the postfilter 232, whose input again is connected to a further output of the extractor 214.

As has already been mentioned, the extractor 214 extracts the quantizing indices $i_c(n)$ representing the quantized prefilter residual signal from the encoded data stream at the input 202. In the uniform dequantizer 220, these quantizing indices are dequantized to the quantized residual values $q_c(n)$. Inherently, this dequantizing remains within the allowed quantizing levels, since the quantizing indices $i_c(n)$ have already been clipped on the encoder side. The step size adaption is performed in a backward-adaptive manner, in the same way as in the step size adaption block 54 of the encoder of FIG. 1. Without transmission errors, the dequantizer 220 generates the same values as the dequantizer 50 of the encoder of FIG. 1. Therefore, the elements 222, 226, 228 and 224 based on the encoded prediction coefficients obtain the same result as it is obtained in the encoder 10 of FIG. 1 at the output of the adder 48, i.e. a dequantized or reconstructed prefilter signal, respectively. The latter is filtered in the postfilter 232, with a transmission function corresponding to the masking threshold, wherein the postfilter 232 is adjusted adaptively by the coefficient decoder 230, which appropriately adjust the postfilter 230 or its filter coefficients, respectively, based on the prefilter coefficient information.

Assuming that the encoder 10 is provided with coefficient encoders 30 and 38, which are implemented as described in FIG. 4, the coefficient decoders 224 and 230 of the encoder 200 but also the coefficient decoder 40 of the encoder 10 are structured as shown in FIG. 6. As can be seen, a coefficient decoder comprises two delay members 302, 304, a step size adaption module 306 forming a step size adaption block together with the delay member 302, a uniform dequantizer 308 with uniform step size, a prediction filter 310, two adders 312 and 314, an LSF reconversion module 316 as well as an input 318 for receiving the quantized LSF residual values $l_e(n)$ with constant offset $-l_c$ and an output 320 for outputting the reconstructed prediction or prefilter coefficients, respectively. Thereby, the delay member 302 is connected between an input of the step size adaption module 306 and the input 318, an input of the dequantizer 308 is also connected to the input 318, and a step size adaption input of the dequantizer 308 is connected to an output of the step size adaption module 306. The mode of operation and connectivity of the elements 302, 306 and 308 corresponds to the one of 112, 116 and 122 in FIG. 4. A closed-loop predictor of delay member 304, prediction filter 310 and adder 312, which are connected in a common loop by connecting the delay member 304 between an output of the adder 312 and an input of the prediction filter 310, and by connecting a first input of the adder 312 to the output of the dequantizer 308, and by connecting a second input of the adder 312 to an output of the prediction filter 310, is connected to an output of the dequantizer 308. Elements 304, 310 and 312 correspond to the elements 120, 118 and 114 of FIG. 4 in their mode of operation and connectivity. Additionally, the output of the adder 312 is connected to a first input of the adder 314, at the second input of which the constant value $l_c$ is applied, wherein, according to the present embodiment, the constant $l_c$ is an agreed amount, which is present to both encoder and the decoder and thus does not have to be transmitted as part of the side information, although the latter would also be possible. The LSF reconversion module 316 is connected between an output of the adder 314 and the output 320.

The LSF residual signal indices $l_e(n)$ incoming at the input 318 are dequantized by the dequantizer 308, wherein the dequantizer 308 uses the backward-adaptive step size values $\Delta(n)$, which had been determined in a backward-adaptive manner by the step size adaption module 306 from already dequantized quantizing indices, namely those that had been delayed by a sample by the delay member 302. The adder 312 adds the predicted signal to the dequantized LSF residual values, which calculates the combination of delay member 304 and prediction filter 210 from sums that the adder 312 has already calculated previously and thus represent the reconstructed LSF values, which are merely provided with a constant offset by the constant offset $l_c$. The latter is corrected by the adder 314 by adding the value $l_c$ to the LSF values, which the adder 312 outputs. Thus, at the output of the adder 314, the reconstructed LSF values result, which are converted by the module 316 from the LSF domain back to reconstructed prediction or prefilter coefficients, respectively. Therefore, the LSF reconversion module 316 considers all spectral line frequencies, whereas the discussion of the other elements of FIG. 6 was limited to the description of one spectral line frequency. However, the elements 302-314 perform the above-described measures also at the other spectral line frequencies.

After providing both encoder and decoder embodiments above, listening test results will be presented below based on FIG. 7, as they have been obtained via an encoding scheme according to FIGS. 1, 4, 5 and 6. In the performed tests, both an encoder according to FIGS. 1, 4 and 6 and an encoder according to the comparison ULD encoding scheme discussed at the beginning of the description of the Figs. have been tested, in a listening test according to the MUSHRA standard, where the moderators have been omitted. The MUSHRA test has been performed on a laptop computer with external digital-to-analog converter and STAX amplifier/headphones in a quiet office environment. The group of eight test listeners was made up of expert and non-expert listeners. Before the participants began the listening test, they had the opportunity to listen to a test set. The tests have been performed with twelve mono audio files of the MPEG test set, wherein all had a sample frequency of 32 kHz, namely es01 (Suzanne Vega), es02 (male speech), German), es03 (female speech, English), sc01 (trumpet), sc02 (orchestra), sc03 (pop music), si01 (cembalo), si02 (castanets), si03 (pitch pipe), sm01 (bagpipe), sm02 (glockenspiel), sm03 (puckled strings).

For the comparison ULD encoding scheme, a backward-adaptive prediction with a length of 64 has been used in the implementation, together with a backward-adaptive Golomb encoder for entropy encoding, with a constant bit rate of 64 kBit/s. In contrast, for implementing the encoder according to FIGS. 1, 4 and 6, a forward-adaptive predictor with a length of 12 has been used, wherein the number of different quantizing levels has been limited to 3, namely such that $\forall n: i_c(n) \in \{-1,0,1\}$. This resulted, together with the encoded side information, in a constant bit rate of 64 kBit/s, which means the same bit rate.

Figure 7:
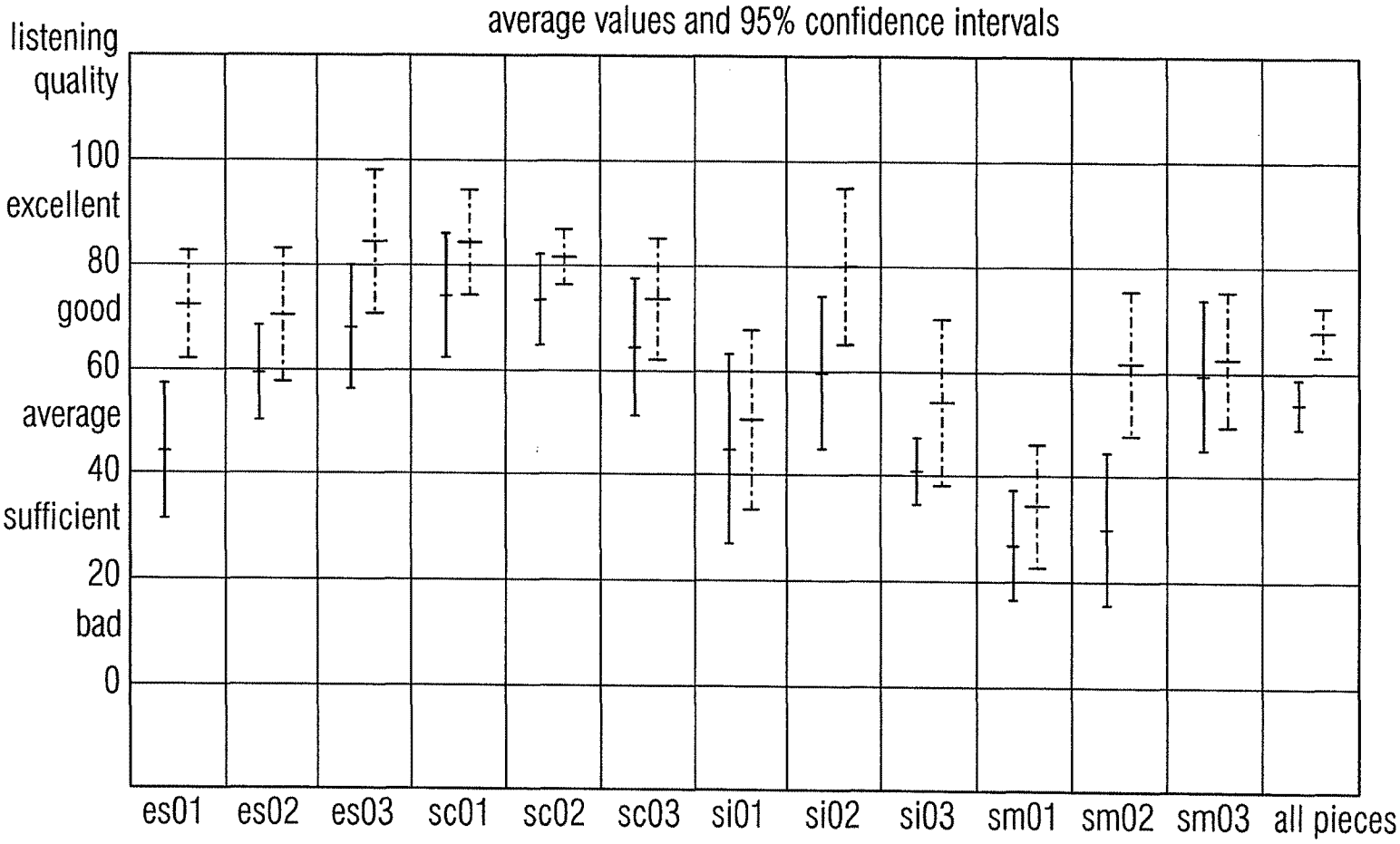
FIG. 7 is a graph for illustrating listening test results.

The results of the MUSHRA listening tests are shown in FIG. 7, wherein both the average values and 95% confidence intervals are shown, for the twelve test pieces individually and for the overall result across all pieces. As long as the confidence intervals overlap, there is no statistically significant difference between the encoding methods.

The piece es01 (Suzanne Vega) is a good example for the superiority of the encoding scheme according to FIGS. 1, 4, 5 and 6 at lower bit rates. The higher portions of the decoded signal spectrum show less audible artifacts compared to the comparison ULD encoding scheme. This results in a significantly higher rating of the scheme according to FIGS. 1, 4, 5 and 6.

The signal transients of the piece sm02 (Glockenspiel) have a high bit rate requirement for the comparison ULD encoding scheme. In the used 64 kBit/s, the comparison ULD encoding scheme generates spurious encoding artifacts across full blocks of samples. In contrast, the encoder operating according to FIGS. 1, 4 and 6 provides a significantly improved listening quality or perceptual quality, respectively. The overall rating, seen in the graph of FIG. 7 on the right, of the encoding scheme formed according to FIGS. 1, 4 and 6 obtained a significantly better rating than the comparison ULD encoding scheme. Overall, this encoding scheme got an overall rating of "good audio quality" under the given test conditions.

In summary, from the above-described embodiments, an audio encoding scheme with low delay results, which uses a block-wise forward-adaptive prediction together with clipping/limiting instead of a backward-adaptive sample-wise prediction. The noise shaping differs from the comparison ULD encoding scheme. The listening test has shown that the above-described embodiments are superior to the backward-adaptive method according to the comparison ULD encoding scheme in the case of lower bit rates. Subsequently, the same are a candidate for closing the bit rate gap between high quality voice encoders and audio encoders with low delay. Overall, the above-described embodiments provided a possibility for audio encoding schemes having a very low delay of 6-8 ms for reduced bit rates, which has the following advantages compared to the comparison ULD encoder. The same is more robust against high quantizing errors, has additional noise shaping abilities, has a better ability for obtaining a constant bit rate, and shows a better error recovery behavior. The problem of audible quantizing noise at positions without signal, as is the case in the comparison ULD encoding scheme, is addressed by the embodiment by a modified way of increasing the quantizing noise above the masking threshold, namely by adding the signal spectrum to the masking threshold instead of uniformly increasing the masking threshold to a certain degree. In that way, there is no audible quantizing noise at positions without signal.

In other words, the above embodiments differ from the comparison ULD encoding scheme in the following way. In the comparison ULD encoding scheme, backward-adaptive prediction is used, which means that the coefficients for the prediction filter A(z) are updated on a sample-by-sample basis from previously decoded signal values. A quantizer having a variable step size is used, wherein the step size adapts all 128 samples by using information from the entropy encoders and the same is transmitted as side information to the decoder side. By this procedure, the quantizing step size is increased, which adds more white noise to the prefiltered signal and thus uniformly increases the masking threshold. If the backward-adaptive prediction is replaced with a forward-adaptive block-wise prediction in the comparison ULD encoding scheme, which means that the coefficients for the prediction filter A(z) are calculated once for 128 samples from the unquantized prefiltered samples, and transmitted as side information, and if the quantizing step size is adapted for the 128 samples by using information from the entropy encoder and transmitted as side information to the decoder side, the quantizing step size is still increased, as it is the case in the comparison ULD encoding scheme, but the predictor update is unaffected by any quantization. The above embodiments used only a forward adapted block-wise prediction, wherein additionally the quantizer had merely a given number 2N+1 of quantizing stages having a fixed step size. For the prefiltered signals x(n) with amplitudes outside the quantizer range [−NΔ;NΔ] the quantized signal was limited to [−NΔ;NΔ]. This results in a quantizing noise having a PSD, which is no longer white, but copies the PSD of the input signal, i.e. the prefiltered audio signal.

As a conclusion, the following is to be noted on the above embodiments. First, it should be noted that different possibilities exist for transmitting information about the representation of the masking threshold, as they are obtained by the perceptual model module 26 within the encoder to the prefilter 34 or prediction filter 44, respectively, and to the decoder, and there particularly to the postfilter 232 and the prediction filter 226. Particularly, it should be noted that it is not necessitated that the coefficient decoders 32 and 40 within the encoder receive exactly the same information with regard to the masking threshold, as it is output at the output 14 of the encoder and as it is received at the output 202 of the decoder. Rather, it is possible, that, for example in a structure of the coefficient encoder 30 according to FIG. 4, the obtained indices $l_e(n)$ as well as the prefilter residual signal quantizing indices $i_c(n)$ originate also only from an amount of three values, namely −1, 0, 1, and that the bit stream generator 24 maps these indices just as clearly to corresponding n bit words. According to an embodiment according to FIG. 1, 4 or 5, 6, respectively, the prefilter quantizing indices, the prediction coefficient quantizing indices and/or the prefilter quantizing indices each originating from the amount −1, 0, 1, are mapped in groups of fives to a 8-bit word, which corresponds to a mapping of $3^5$ possibilities to $2^8$ bit words. Since the mapping is not subjective, several 8-bit words remain unused and can be used in other ways, such as for synchronization or the same.

On this occasion, the following should be noted. Above, it has been described with reference to FIG. 6 that the structure of the coefficient decoders 32 and 230 is identical. In this case, the prefilter 34 and the postfilter 232 are implemented such that when applying the same filter coefficients they have a transmission function inverse to each other. However, it is of course also possible that, for example, the coefficient encoder 32 performs an additional conversion of the filter coefficients, so that the prefilter has a transmission function mainly corresponding to the inverse of the masking threshold, whereas the postfilter has a transmission function mainly corresponding to the masking threshold.

In the above embodiments, it has been assumed that the masking threshold is calculated in the module 26. However, it should be noted that the calculated threshold does not have to exactly correspond to the psychoacoustic threshold, but can represent a more or less exact estimation of the same, which might not consider all psychoacoustic effects but merely some of them. Particularly, the threshold can represent a psychoacoustically motivated threshold, which has been deliberately subject to a modification in contrast to an estimation of the psychoacoustic masking threshold.

Further, it should be noted that the backward-adaptive adaption of the step size in quantizing the prefilter residual signal values does not necessarily have to be present. Rather, in certain application cases, a fixed step size can be sufficient.

Further, it should be noted that the present invention is not limited to the field of audio encoding. Rather, the signal to be encoded can also be a signal used for stimulating a fingertip in a cyber-space glove, wherein the perceptual model 26 in this case considers certain tactile characteristics, which the human sense of touch can no longer perceive. Another example for an information signal to be encoded would be, for example, a video signal. Particularly the information signal to be encoded could be a brightness information of a pixel or image point, respectively, wherein the perceptual model 26 could also consider different temporal, local and frequency psychovisual covering effects, i.e. a visual masking threshold.

Additionally, it should be noted that quantizer 56 and limiter 58 or quantizer 108 and limiter 110, respectively, do not have to be separate components. Rather, the mapping of the unquantized values to the quantized/clipped values could also be performed by a single mapping. On the other hand, the quantizer 56 or the quantizer 108, respectively, could also be realized by a series connection of a divider followed by a quantizer with uniform and constant step size, where the divider would use the step size value Δ(n) obtained from the respective step size adaption module as divisor, while the residual signal to be encoded formed the dividend. The quantizer having a constant and uniform step size could be provided as simple rounding module, which rounds the division result to the next integer, whereupon the subsequent limiter would then limit the integer as described above to an integer of the allowed amount C. In the respective dequantizer, a uniform dequantization would simply be performed with Δ(n) as multiplicator.

Figure 8A:
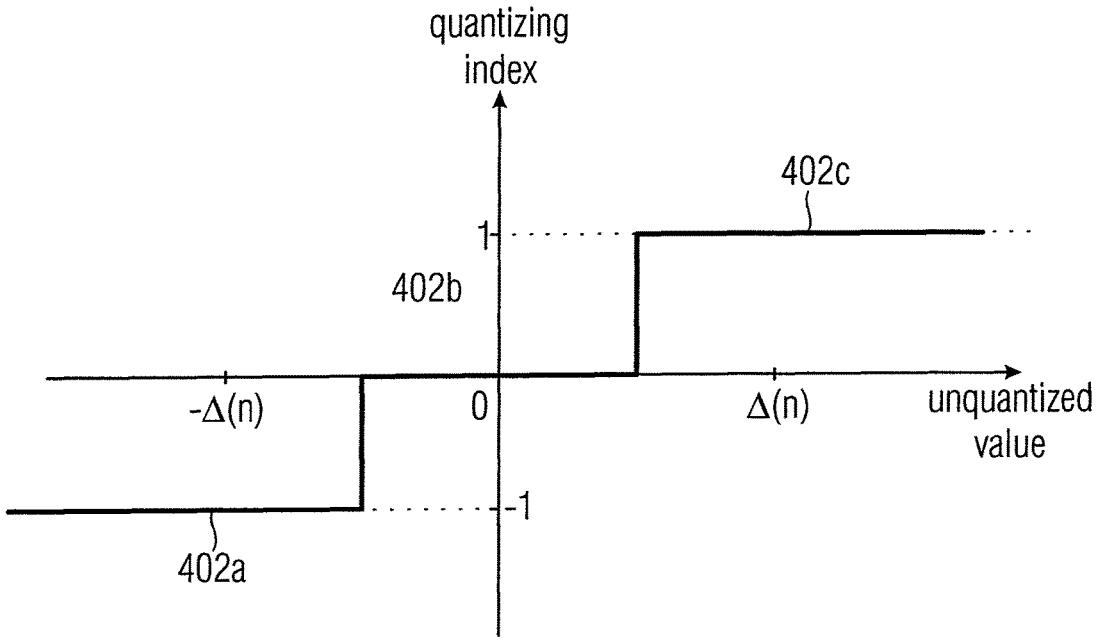
FIGS. 8*a* to 8*c* are graphs of exemplary quantizing functions that can be used in the quantizing and quantizing/clip means, respectively, in FIGS. 1, 4, 5 and 6.
Figure 8B:
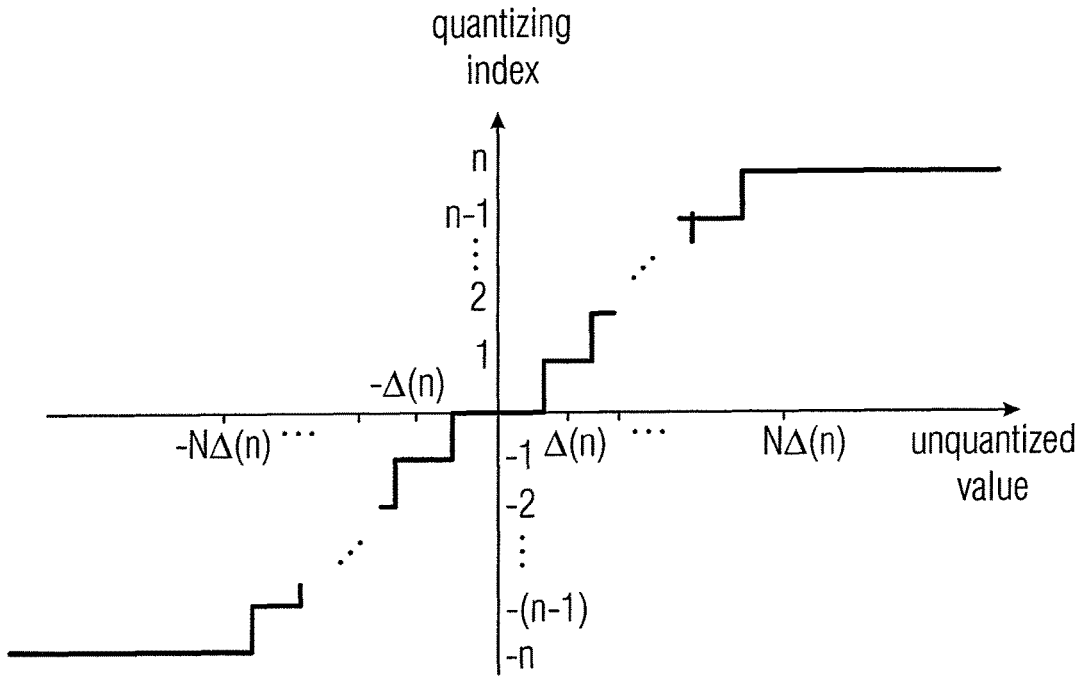
Figure 8C:
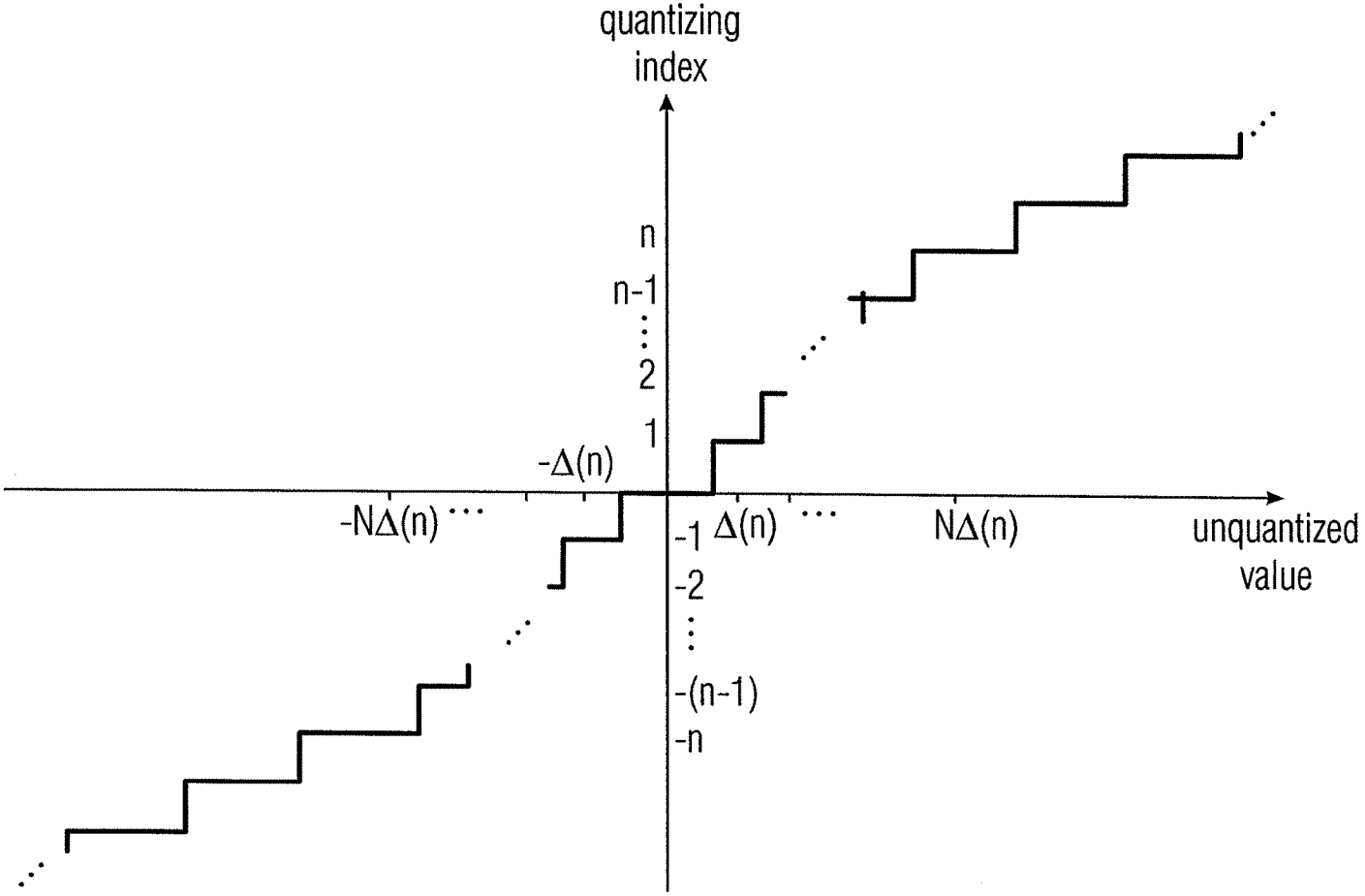

Further, it should be noted that the above embodiments were restricted to applications having a constant bit rate. However, the present invention is not limited thereto and thus quantization by clipping of, for example, the prefiltered signal used in these embodiments is only one possible alternative. Instead of clipping, a quantizing function with nonlinear characteristic curve could be used. For illustrating this, reference is made to FIGS. 8*a* to 8*c*. FIG. 8*a* shows the above-used quantizing function resulting in clipping on three quantizing stages, i.e. a step function with three stages 402*a, b, c*, which maps unquantized values (x axis) to quantizing indices (y axis), wherein the quantizing stage height or quantizing step size Δ(n) is also marked. As can be seen, unquantized values higher than Δ(n)/2 are clipped to the respective next stage 402*a* or *c*, respectively. FIG. 8*b* shows generally a quantizing function resulting in clipping to 2n+1 quantizing stages. The quantizing step size Δ(n) is again shown. The quantizing functions of FIGS. 8*a* and 8*b* represent quantizing functions, where the quantization between thresholds −Δ(n) and Δ(n) or −NΔ(n) and NΔ(n) takes place in uniform manner, i.e. with the same stage height, whereupon the quantizing stage function proceeds in a flat way, which corresponds to clipping. FIG. 8*c* shows a nonlinear quantizing function, where the quantizing function proceeds across the area between −NΔ(n) and NΔ(n) not completely flat but with a lower slope, i.e. with a larger step size or stage height, respectively, compared to the first area. This nonlinear quantization does not inherently result in a constant bit rate, as it was the case in the above embodiments, but also generates the above-described deformation of the quantizing noise, so that the same adjusts to the signal PSD. Merely as a precautionary measure, it should be noted with reference to FIGS. 8*a-c*, that instead of the uniform quantizing areas non-uniform quantization could be used, where, for example, the stage height increases continuously, wherein the stage heights could be scalable via a stage height adjustment value Δ(n) while maintaining their mutual relations. Therefore, for example, the unquantized value could be mapped via a nonlinear function to an intermediate value in the respective quantizer, wherein either before or afterwards multiplication with Δ(n) is performed, and finally the resulting value is uniformly quantized. In the respective dequantizer, the inverse would be performed, which means uniform dequantization via Δ(n) followed by inverse nonlinear mapping or, conversely, nonlinear conversion mapping at first followed by dequantization with Δ(n). Finally, it should be noted that a continuously uniform, i.e. linear quantization by obtaining the above-described effect of deformation of the error PSD would also be possible, when the stage height would be adjusted so high or quantization so coarse that this quantization effectively works like a nonlinear quantization with regard to the signal statistic of the signal to be quantized, such as the prefiltered signal, wherein this stage height adjustment is again made possible by the forward adaptivity of the prediction.

Further, the above-described embodiments can also be varied with regard to the processing of the encoded bit stream. Particularly, bit stream generator and extractor 214, respectively, could also be omitted.

The different quantizing indices, namely the residual values of the prefiltered signals, the residual values of the prefilter coefficients and the residual values of the prediction coefficients could also be transmitted in parallel to each other, stored or made available in another way for decoding, separately via individual channels. On the other hand, in the case that a constant bit rate is not imperative, these data could also be entropy-encoded.

Particularly, the above functions in the blocks of FIGS. 1, 4, 5 and 6 could be implemented individually or in combination by sub-program routines. Alternatively, implementation of an inventive apparatus in the form of an integrated circuit is also possible, where these blocks are implemented, for example, as individual circuit parts of an ASIC.

Particularly, it should be noted that depending on the circumstances, the inventive scheme could also be implemented in software. The implementation can be made on a digital memory medium, particularly a disc or CD with electronically readable control signals, which can cooperate with a programmable computer system such that the respective method is performed. Generally, thus, the invention consists also in a computer program product having a program code stored on a machine-readable carrier for performing the inventive method when the computer program product runs on the computer. In other words, the invention can be realized as a computer program having a program code for performing the method when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for encoding an information signal into an encoded information signal, wherein the apparatus is configured to determine one or more first linear prediction coefficients so as to define a transfer function which approximates an inverse of a psycho-perceptibility motivated threshold;

filter the information signal using the one or more first linear prediction coefficients, thereby attaining a prefiltered signal;

determine one or more second linear prediction coefficients based on the prefiltered signal;

predict the prefiltered signal using the one or more second linear prediction coefficients to attain a predicted signal and a prediction error for the prefiltered signal;

quantize the prediction error for attaining a quantized prediction error, form, based on the quantized prediction error and the predicted signal, a reconstructed signal and perform the prediction of the prefiltered signal based on the reconstructed signal; and encode into the encoded information signal the one or more first linear prediction coefficients, the one or more second linear prediction coefficients and the quantized prediction error, wherein the information signal is an audio signal, wherein the apparatus comprises a computer.

2. The apparatus according to claim 1, wherein the apparatus is implemented to quantize the prediction error via a quantizing function, which maps unquantized values of the prediction error to quantizing indices of quantizing stages, and whose course below a threshold is steeper than above a threshold.

3. The apparatus according to claim 1, wherein the apparatus is implemented to attain a quantizing stage height $\Delta(n)$ of the quantizing function in a backward-adaptive manner from the quantized prediction error.

4. The apparatus according to claim 1, wherein the apparatus is implemented such that unquantized values of the prediction error are quantized via clipping by the quantizing function, which maps the unquantized values of the prediction error to quantizing indices of a constant and limited first number of quantizing stages for attaining the quantized prediction error.

5. The apparatus according to claim 4, wherein the apparatus is implemented to attain a quantizing stage height $\Delta(n)$ of the quantizing function for quantizing a value $(r(n))$ of the prediction error in a backward-adaptive manner of two past quantizing indices $i_c(n-1)$ and $i_c(n-2)$ of the quantized prediction error according to $\Delta(n)=\beta\Delta(n-1)+\delta(n)$, with $\beta\epsilon[0.0;1.0]$, $\delta(n)=\delta_0$ for $|i_c(n-1)+i_c(n-2)|\leq I$ and $\delta(n)=\delta_1$ for $|i_c(n-1)+i_c(n-2)|>I$ with constant parameters $\delta_0$, $\delta_1$, I, wherein $\Delta(n-1)$ represents a quantizing stage height attained for quantizing a previous value of the prediction error.

6. The apparatus according to claim 4, wherein the apparatus is implemented to quantize the prediction error in a nonlinear manner.

7. The apparatus according to claim 4, wherein the constant and limited first number is 3.

8. The apparatus according to claim 1, wherein the apparatus is implemented to determine the psycho-perceptibility motivated threshold in a block-wise manner from the information signal.

9. The apparatus according to claim 1, wherein the apparatus is configured to encode the one or more first linear prediction coefficients in a line spectral frequency domain.

10. The apparatus according to claim 1, wherein the apparatus is implemented to determine the psycho-perceptibility motivated threshold in a block-wise manner and to represent the psycho-perceptibility motivated threshold in filter coefficients, to subject the filter coefficients to a prediction and to subject a filter coefficient residual signal resulting from the prediction to a quantization via a further quantizing function, which maps the unquantized values of the filter coefficient residual signal to quantizing indices of quantizing stages, and whose course below a further threshold is steeper than above the further threshold, for attaining a quantized filter coefficient residual signal, wherein the apparatus is configured to also encode into encoded information signal the quantized filter coefficient residual signal.

11. The apparatus according to claim 10, wherein the apparatus is implemented such that the unquantized values of the filter coefficient residual signal are quantized via clipping by the further quantizing function, which maps the unquantized values of the filter coefficient residual signal to quantizing indices of a constant and limited second number of quantizing stages.

12. The apparatus according to claim 11, wherein the apparatus is implemented such that the prediction is performed in a backward-adaptive manner based on quantizing indices of the quantized filter coefficient residual signal.

13. The apparatus according to claim 10, wherein the apparatus is implemented such that the prediction of the filter coefficients is performed by using a prediction filter with constant coefficients.

14. The apparatus according to claim 10, wherein the apparatus is further implemented to subject the filter coefficients for representing the psycho-perceptibility motivated threshold to a subtraction with a constant value, prior to subjecting the filter coefficients to prediction.

15. The apparatus according to claim 1, wherein the apparatus is implemented to encode into the encoded information signal the one or more second linear prediction coefficients in LSF domain.

16. A method for encoding an information signal into an encoded information signal, comprising:

determine one or more first linear prediction coefficients so as to define a transfer function which approximates an inverse of a psycho-perceptibility motivated threshold;

filtering the information signal using the one or more first linear prediction coefficients so as to attain a prefiltered signal;

determining one or more second linear prediction coefficients based on the prefiltered signal;

predicting the prefiltered signal using the one or more second linear prediction coefficients to attain a predicted signal and a prediction error for the prefiltered signal;

quantizing the prediction error to attain a quantized prediction error;

forming, based on the quantized prediction error and the predicted signal, a reconstructed signal and performing the prediction of the prefiltered signal based on the reconstructed signal; and encoding into the encoded information signal the one or more first linear prediction coefficients, the one or more second linear prediction coefficients and the quantized prediction error, wherein the information signal is an audio signal.

17. A non-transitory computer-readable medium having stored thereon a computer program with a program code for performing a method according to claim 16.

* * * * *